US011471008B2

(12) United States Patent
Yang et al.

(10) Patent No.: US 11,471,008 B2
(45) Date of Patent: Oct. 18, 2022

(54) REINFORCED TOWEL DRYER

(71) Applicant: SHENZHEN ANTOP TECHNOLOGY CO., LTD, Shenzhen (CN)

(72) Inventors: Ruidian Yang, Shenzhen (CN); Xianquan Liao, Shenzhen (CN)

(73) Assignee: SHENZHEN ANTOP TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/128,247

(22) Filed: Dec. 21, 2020

(65) Prior Publication Data

US 2022/0095855 A1 Mar. 31, 2022

(30) Foreign Application Priority Data

Sep. 25, 2020 (CN) ..... 202022150338.9
Sep. 30, 2020 (CN) ..... 202022223249.2
Sep. 30, 2020 (CN) ..... 202022223928

(51) Int. Cl.
*A47K 10/06* (2006.01)
*A47K 10/48* (2006.01)
*F28D 21/00* (2006.01)

(52) U.S. Cl.
CPC ..... *A47K 10/06* (2013.01); *A47K 10/48* (2013.01); *F28D 2021/0036* (2013.01)

(58) Field of Classification Search
CPC .. A47K 10/06; A47K 10/48; F28D 2021/0036
USPC ..... 34/621
See application file for complete search history.

(56) References Cited

U.S. PATENT DOCUMENTS 2,668,368 A * 2/1954 Jacobs ..... A47K 10/06 34/621
5,642,462 A * 6/1997 Huff ..... A47K 10/06 211/105.1
8,143,553 B2 * 3/2012 DeFranco ..... A47K 10/06 219/201
9,918,594 B2 * 3/2018 Robertson ..... A47K 10/04
11,064,847 B2 * 7/2021 Wallander ..... A61M 21/00

FOREIGN PATENT DOCUMENTS

WO WO-2019165174 A1 * 8/2019 ..... F24H 9/2064

* cited by examiner

*Primary Examiner* — Stephen M Gravini
(74) *Attorney, Agent, or Firm* — Soroker Agmon Nordman Pte Ltd

(57) ABSTRACT

Disclosed is a reinforced towel dryer, comprising hanger and main machine comprising casing, heater, and fan. Bottom of the casing is provided with air outlet and inlet, the heater is located in air flow path of fan. The hanger comprises hanging rod and two supports having supporting section and vertical section abutting against wall. Vertical section is connected to rear end of supporting section. End of the hanging rod is supported on corresponding supporting section, upper end of vertical section is fixedly connected to rear side of casing. When casing is installed on wall, vertical section abuts against wall, then when fabrics are on the hanger, wall acts as rear fulcrum and bears heavy weight, weight on casing can be reduced to support hanger. There is no need for metal plate in casing, so structure of the casing is simplified, weight of the casing and the cost are reduced.

20 Claims, 17 Drawing Sheets

REINFORCED TOWEL DRYER

CROSS-REFERENCE TO RELATED APPLICATIONS

This application claims the priority of the Chinese patent application filed at the Chinese Patent Office on Sep. 25, 2020, with the application number 202022150338.9 and titled "reinforced towel dryer", the entire content of which is incorporated herein by reference.

This application claims the priority of the Chinese patent application filed at the Chinese Patent Office on Sep. 30, 2020 with an application number 202022223249.2 and titled "towel sterilizer", the entire content of which is incorporated herein by reference.

This application claims the priority of the Chinese patent application filed at the Chinese Patent Office on Sep. 30, 2020, with the application number 202022223928.X and titled "portable towel sterilizer", the entire content of which is incorporated herein by reference.

TECHNICAL FIELD

This application pertains to the field of dryers, and more specifically to a reinforced towel dryer.

BACKGROUND

The statements here only provide background information related to this application, and do not necessarily constitute prior art. Towel dryers are generally devices used to dry towels, fabrics and other fabrics to prevent fabrics from becoming moldy and which are easy to be used. In the current towel dryer, a heater is generally installed in the main machine to heat the fabrics on the drying hanger. Currently, there are two types of towel dryers, wherein one has a structure in which the hanger and the main machine are separated, and the hanger and the main machine are separately installed on the wall, which is inconvenient to be installed; and the other is an integrated towel dryer with a hanger connected to the main machine and installed on the bottom of the main machine, wherein only the main machine needs to be fixed. However, in the integrated towel dryer, the connection between the hanger and the main machine is often easily deformed, and a large-area metal plate needs to be installed in the casing of the main machine, which increases the weight and cost of the main machine.

SUMMARY

The purpose of the embodiments of the present application is to provide a reinforced towel dryer to solve the problem of heavy weight and high cost of the integrated towel dryer in the related art.

In order to achieve the above purpose, the technical solution used in the embodiments of the present application is to provide a reinforced towel dryer, comprising a main machine and a hanger for hanging fabrics, the main machine comprising a casing and a heated installed in the casing and a fan installed in the casing, the bottom of the casing is provided with an air outlet corresponding to the outlet of the fan, the bottom of the casing is provided with an air inlet, the heater is provided in the air flow path of the fan, the hanger comprises a hanging rod and two supports respectively supporting both ends of the hanging rod, each of the supports has a supporting section and a vertical section for abutting against the wall, the lower end of the vertical section is fixedly connected to the rear end of the supporting section, the end of the hanging rod is supported on the corresponding supporting section, and the upper end of the vertical section is fixedly connected to the rear side of the casing.

The beneficial effects of the reinforced towel dryer provided by the embodiments of the present application are: Compared with the prior art, the reinforced towel dryer of the present application supports the hanging rod by providing a support, and the support has a vertical section and a supporting section, and the vertical end of the support is fixedly connected to the rear side of the casing. When the casing is installed on the wall, the support can be supported by the casing or the vertical section of the support abuts against the wall, so when the fabric is put on the hanger, the wall will serve as the rear fulcrum of the hanger, and bear heavy weight, and the force-bearing area with the wall and the firmness of the connection are increased, so that the weight on the casing is reduced to stably support the hanger, and there is no need to arrange a metal plate in the casing, so that the structure of the casing is simplified, the weight on the casing and the cost are reduced.

BRIEF DESCRIPTION OF THE DRAWINGS

In order to more clearly describe the technical solutions in the embodiments of the present application, the following will briefly introduce the accompanying drawings used in the description of the embodiments or exemplary technologies. Obviously, the accompanying drawings in the following description are only some embodiments of the present application. Those skilled in the art can obtain other drawings based on these drawings without creative work.

Figure 1:
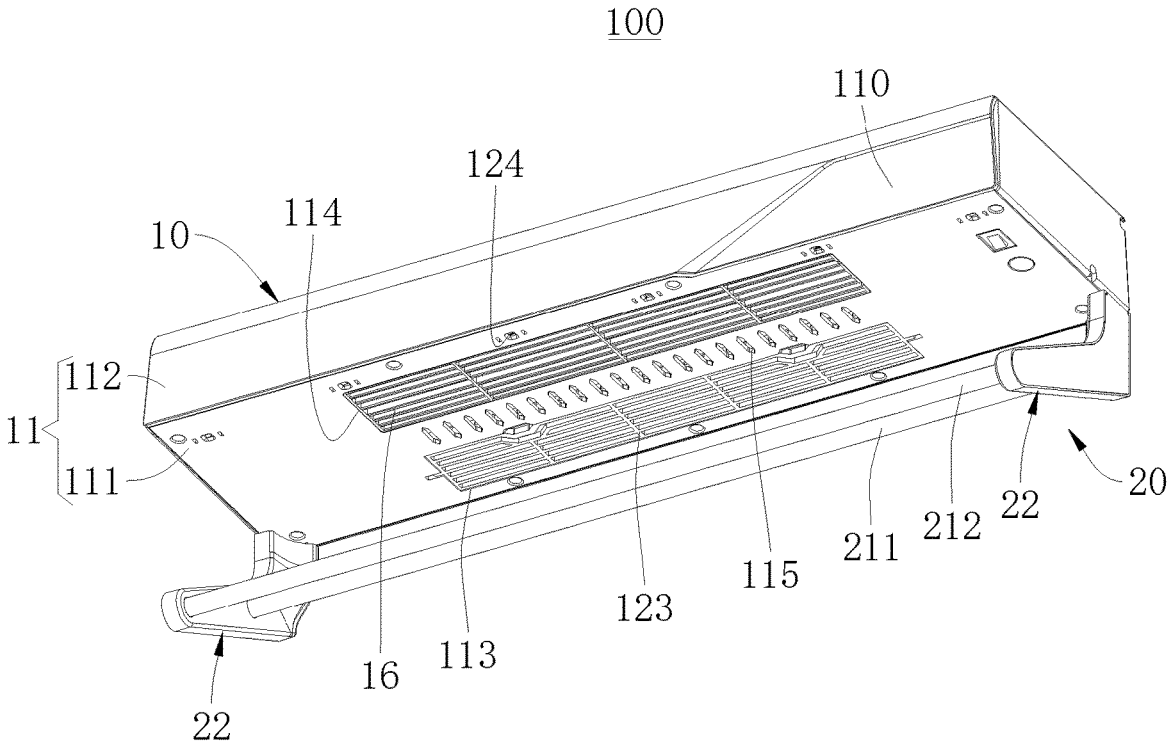
FIG. 1 is a structural schematic diagram 1 of a reinforced towel dryer provided in embodiment 1 of the application.

Among them, the reference numbers in the drawings are mainly referred to:

100—reinforced towel dryer;

10—main machine; 11—casing; 110—control panel; 111—bottom plate; 112—cover; 1121—hook; 1122—wire concealing groove; 113—window; 114—air outlet; 115—air inlet; 116—connecting hole; 121—lamp socket; 122—ultraviolet lamp tube; 123—grill window; 124—ultraviolet LED module; 13—reflector; 131—supporting plate; 132—reflective side plate; 133—air flow hole; 14—heater; 141—heating plate; 142—heat dissipating fin; 15—fan; 151—wind hood; 152—tubular wind wheel; 153—motor; 16—wind guiding window;

20—hanger; 211—hanging rod; 212—supporting rod; 213—supporting arm; 2131—fixing sleeve; 2132—damping sleeve; 214—fulcrum bar;

22—support; 2201—supporting section; 2202—vertical section; 2203—supporting hole; 2204—rotating shaft; 2205—shaft hole; 2206—supporting groove; 2207—opening; 2208—inserting hole; 2209—plug-in hole;

221—fixing shell; 2211—accommodating cavity;

2212—aperture; 2213—positioning column; 2214—reinforcing rib; 222—cover shell; 223—reinforcing plate; 2231—positioning hole; 2232—mounting hole;

23—locking mechanism; 231—inserting block; 2311—clamping slot; 2312—fixing hole; 232—positioning component; 2321—top protrusion; 2322—supporting block; 2323—elastic member; 2324—button; 23241—pushing block; 2325—positioning shaft;

900—wall.

DETAILED DESCRIPTION OF THE EMBODIMENTS

In order to make the technical problems, technical solutions, and beneficial effects to be solved by this application clearer, the following further describes this application in detail with reference to the accompanying drawings and embodiments. It should be understood that the specific embodiments described here are only used to explain the application, but not to limit the application.

References described in the specification of this application to "one embodiment", "some embodiments" or "embodiments" mean that one or more embodiments of the present application comprise a specific feature, structure, or characteristic described in conjunction with the embodiment. Therefore, "in one embodiment", "in some embodiments", "in some other embodiments", "in yet other embodiments", etc. in different places of this specification are not necessarily referred to the same embodiment, but mean "one or more, but not all embodiments", unless otherwise specifically described. In addition, in one or more embodiments, specific features, structures, or characteristics may be combined in any suitable manner.

The English phrase corresponding to the English abbreviation used in this application is as follows:

LED, Light-emitting Diode.

Figure 3:
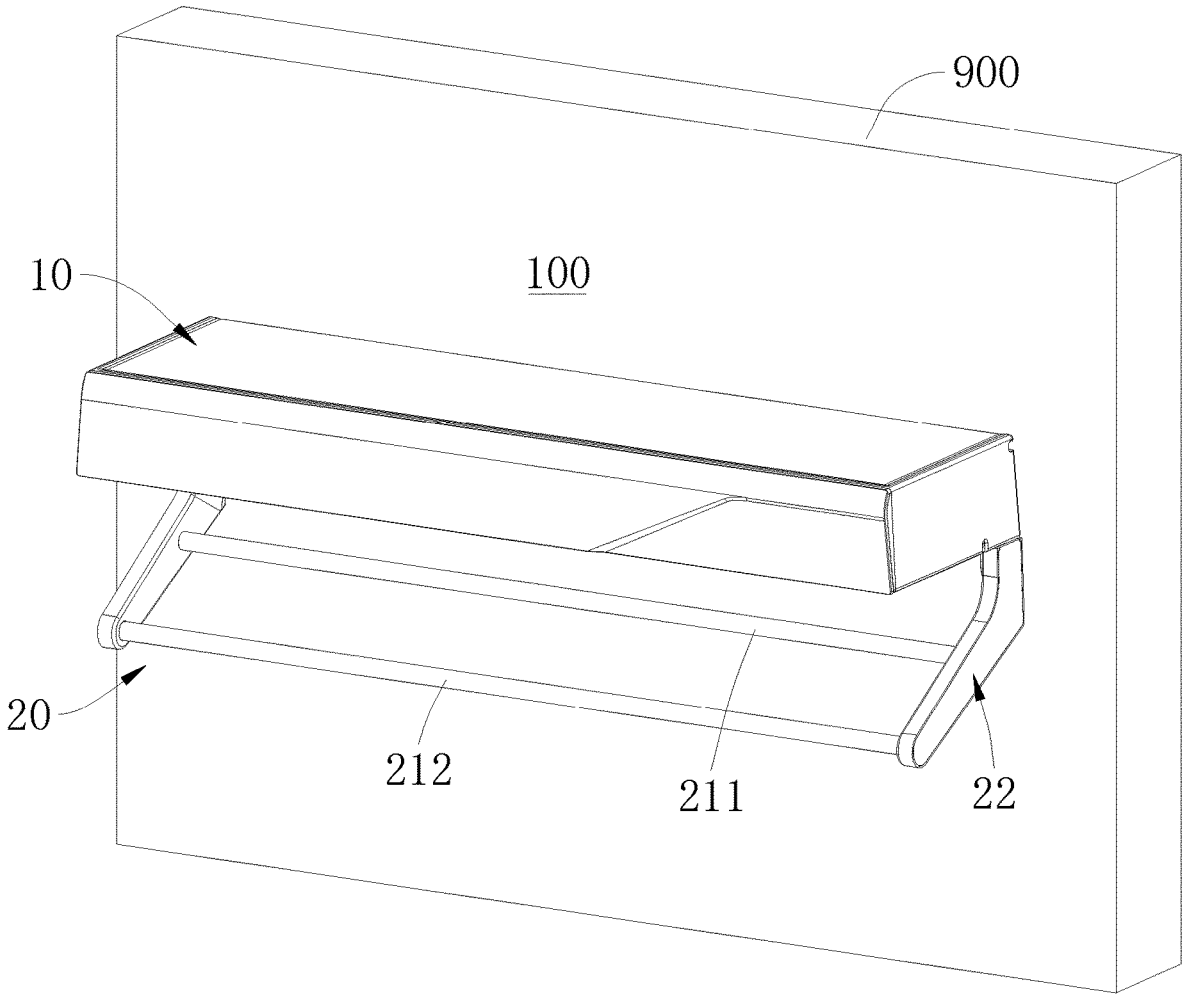
FIG. 3 is a structural schematic diagram of a reinforced towel dryer shown in FIG. 1 installed on a wall.

For the convenience of description, please refer to FIG. 3, which defines in this application: when the main machine 10 is installed on the wall 900, the main machine 10, the casing 11, and the rear side of the reinforced towel dryer 100 are on the side of the main machine 10 close to the wall 900, and the main machine 10, the casing 11 and the front side of the reinforced towel dryer 100 are on the side of the main machine 10 away from the wall 900.

Figure 2:
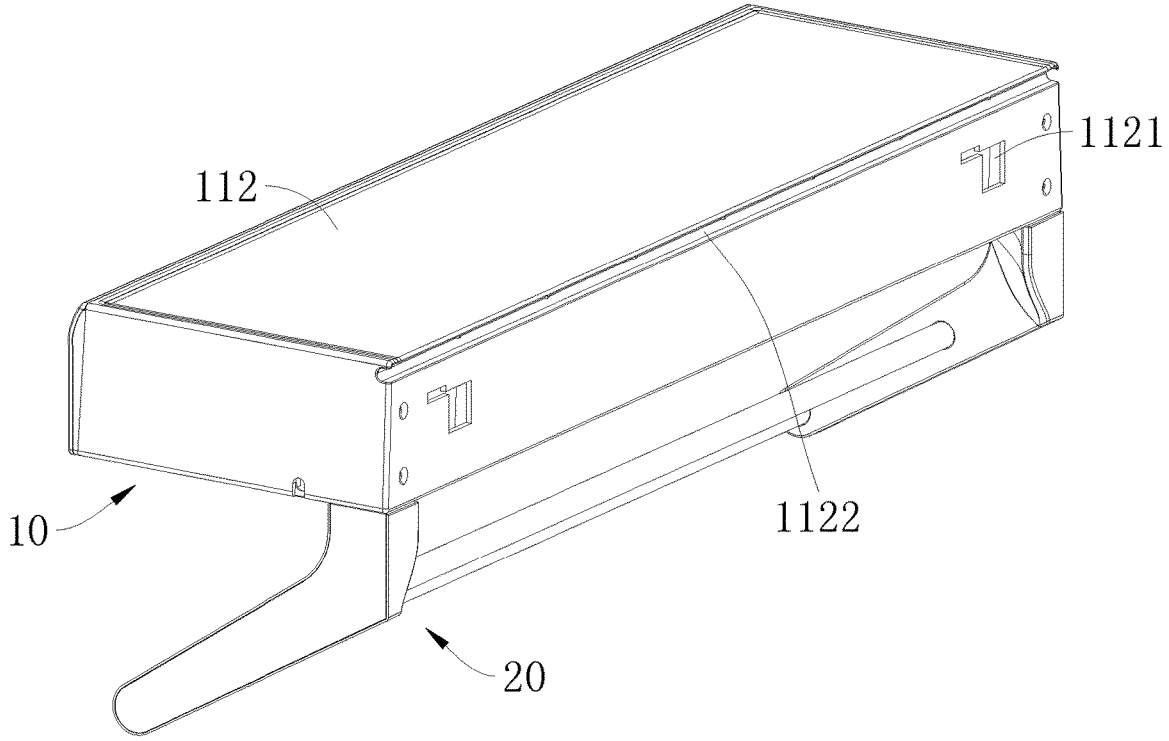
FIG. 2 is a structural schematic diagram 2 of a reinforced towel dryer provided in embodiment 1 of the application.

Referring to FIGS. 1 to 3, the reinforced towel dryer 100 provided in the present application will now be described. The reinforced towel dryer 100 comprises a main machine 10 and a hanger 20 used to hang fabrics, that is, fabrics such as towels can be hung on the hanger 20, and the main machine 10 is provided above the hanger 20, so that the fabrics on the hanger 20 are heated and dried by the main machine 10. The hanger 20 can be supported on the bottom of the casing to integrate the hanger 20 and the main machine 10 together to facilitate installation and use.

Figure 4:
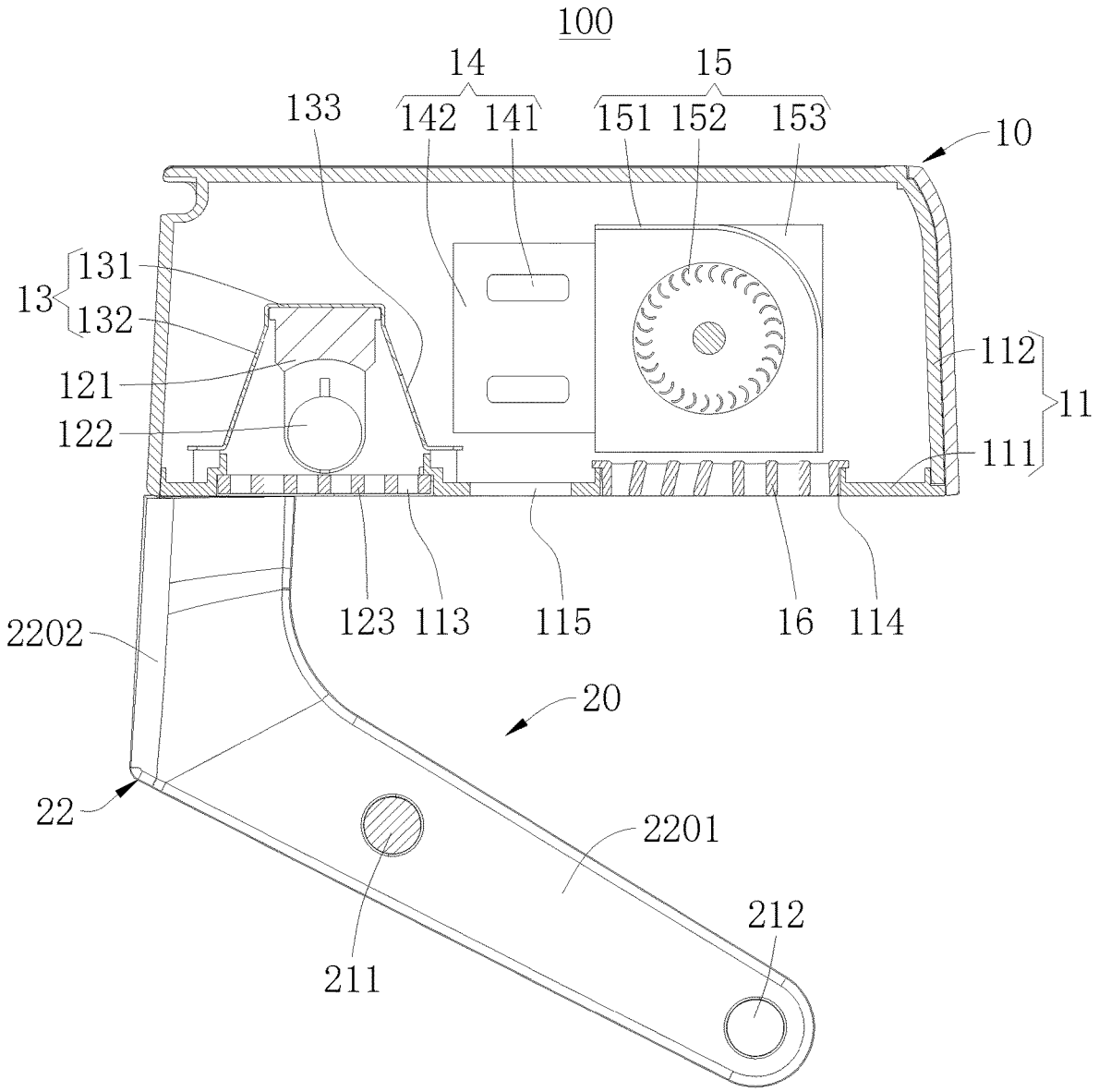
FIG. 4 is a structural schematic cross-sectional diagram of a reinforced towel dryer provided in embodiment 1 of the application.
Figure 5:
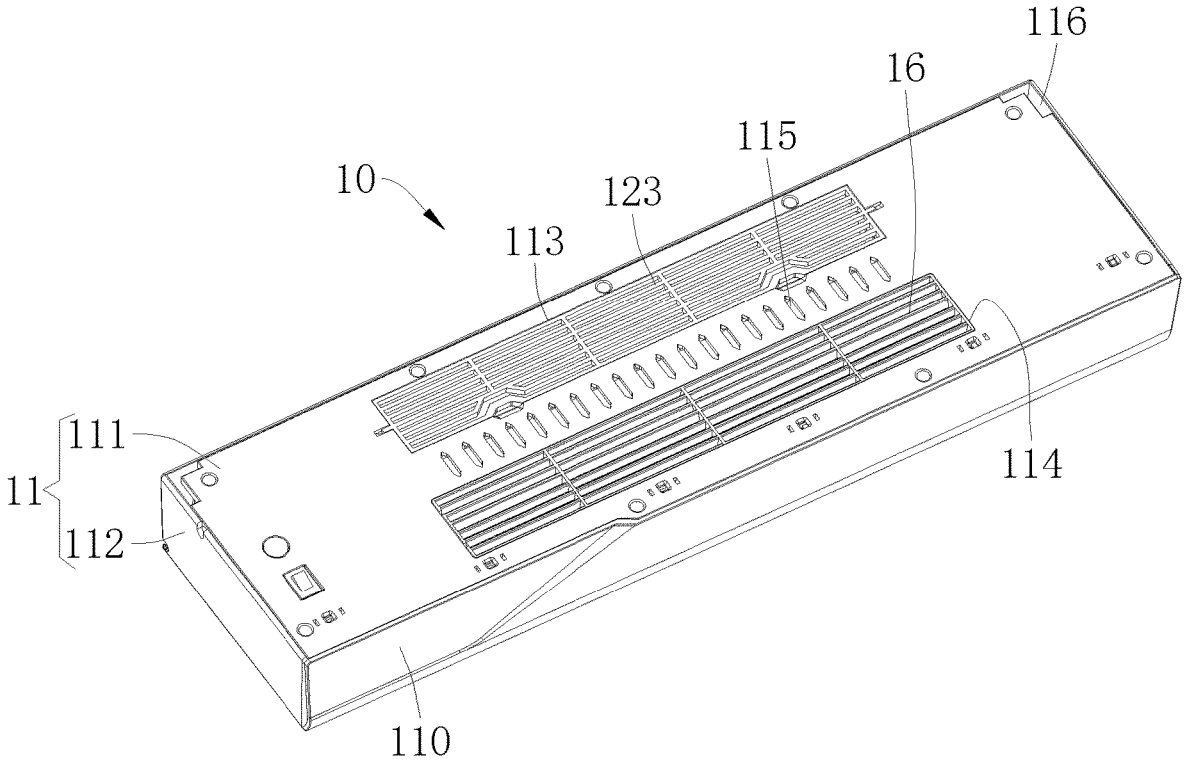
FIG. 5 is a structural schematic diagram of the main machine of a reinforced towel dryer provided in embodiment 1 of the application.
Figure 6:
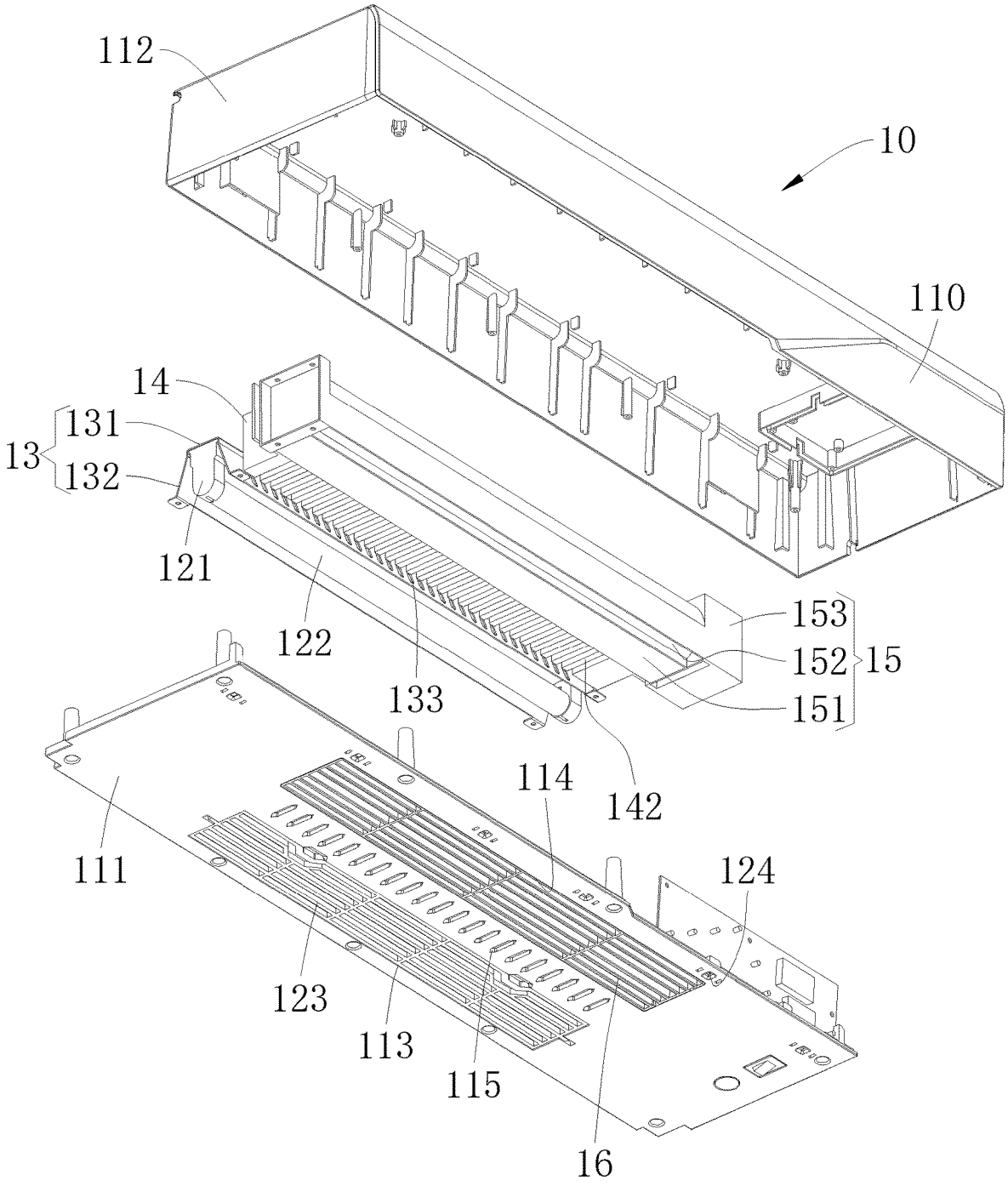
FIG. 6 is a schematic diagram of the exploded structure of the main machine in FIG. 5.

Referring to FIGS. 4 to 6, the main machine 10 comprises a casing 11, a heater 14 and a fan 15. The heater 14 and the fan 15 are installed in the casing 11, and protected by the casing 11. The heater 14 is provided in the air flow path of the fan 15, and used to heat the air, and the fan 15 blows out the heated air to dry the fabrics. The bottom of the casing 11 is provided with an air outlet 114 and an air inlet 115, and the air outlet 114 is located at the outlet of the fan 15 to blow out air flow.

Referring to FIGS. 1 to 4, the hanger 20 comprises a hanging rod 211 and two supports 22 respectively support the two ends of the hanging rod 211, so as to support the hanging rod 211, and then fabrics such as towels can be put on the hanging rod 211. Each support 22 has a supporting section 2201 and a vertical section 2202. The lower end of the vertical section 2202 is fixedly connected to the rear end of the supporting section 2201, the end of the hanging rod 211 is supported on the corresponding supporting section 2201, and the upper end of the vertical section 2202 is fixedly connected to the rear side of the casing 11, so that when the casing 11 is installed on the wall 900, the vertical section 2202 of the support 22 can abut against the wall 900, and when fabrics are put on the hanging rod 211, the lower end of the vertical section 2202 will form a fulcrum with the wall 900, that is, the wall 900 will serve as the rear fulcrum of the hanger 20 and bear heavy weight, thereby reducing the weight on the casing 11 and supporting hanger 20 stably.

Compared with the prior art, the reinforced towel dryer 100 provided by the present application supports the hanging rod 211 by providing a support 22 having a vertical section 2202 and a supporting section 2201, and the vertical end of the support 22 is fixedly connected to the rear side of the casing. When the casing 11 is installed on the wall 900, the support 22 can be supported by the casing 11 or the vertical section 2202 of the support 22 abuts against the wall 900, so when the fabric is put on the hanger 20, the wall 900 will serve as the rear fulcrum of the hanger 20, and bear heavy weight, and the force-bearing area with the wall 900, the firmness of the connection can be increased, so that the weight on the casing 11 is reduced to stably support the hanger 20, and there is no need to arrange a metal plate in the casing 11, so that the structure of the casing 11 is simplified, the weight on the casing 11 and the cost are reduced.

In one embodiment, referring to FIGS. 4 to 6, the main machine 10 further comprises an ultraviolet light source installed on the casing 11 and emitting ultraviolet light to sterilize the fabrics on the hanger 20.

In one embodiment, referring to FIGS. 4 to 6, the main machine 10 further comprises a lamp socket 121 installed in the casing 11, the ultraviolet light source is installed on the lamp socket 121, and the ultraviolet light source is supported and powered by the lamp socket 121, so that the ultraviolet light source emits ultraviolet light to sterilize the fabrics. A window 113 is provided on the bottom of the casing 11, and located at a position corresponding to the reflector to expose the ultraviolet light source, so that the ultraviolet light emitted by the ultraviolet light source can irradiate. Using ultraviolet light source, the installation will be easy and the cost will be low. The ultraviolet light source can be detachably installed on the lamp socket 121 to make replacement of the ultraviolet light source easier.

In one embodiment, referring to FIGS. 4 to 6, the ultraviolet light source is an ultraviolet lamp tube 122 installed on, supported and powered by the lamp socket 121, so that the ultraviolet lamp tube 122 emits ultraviolet light to sterilize the fabrics.

In one embodiment, when the ultraviolet light source may be an ultraviolet lamp tube 122, the corresponding lamp socket 121 is a lamp tube socket to support the ultraviolet lamp tube 122. Using the ultraviolet lamp tube 122 can make the emitted ultraviolet light cover a larger area more uniformly. Of course, in some embodiments, the ultraviolet light source may be an ultraviolet light bulb, and the corresponding lamp socket 121 may be a bulb socket. Of course, a plurality of lamp sockets 121 can be provided in the casing, and ultraviolet light bulbs can be installed on each lamp socket 122 respectively.

Of course, in some other embodiments, the ultraviolet light source may also be an ultraviolet LED module 124 emitting ultraviolet light to sterilize the fabric on the hanger 20. When the ultraviolet light source is an ultraviolet LED module 124, the ultraviolet LED module 124 can be installed on the bottom surface of the casing 11, or the ultraviolet LED module 124 can be installed inside the casing 11, and a light-transmitting opening is provided on the bottom surface of the casing 11, allowing the ultraviolet light emitted by the ultraviolet LED module 124 to pass through.

In some other embodiments, the ultraviolet lamp tube 122 and the ultraviolet LED module 124 both can be installed on the casing 11 to increase the coverage area of the ultraviolet light and sterilize the fabrics on the hanger 20 well.

In one embodiment, referring to FIGS. 4 to 6, the main machine 10 further comprises a reflector 13 installed in the casing 11. The reflector 13 is covered on the lamp socket 121, and when the ultraviolet light source is installed on the lamp socket 121, the reflector 13 can be covered on the ultraviolet light source, to reflect the ultraviolet light emitted by the ultraviolet light source to a specified direction to enhance utilization rate of the ultraviolet light and save energy, and also prevent the ultraviolet light emitted by the ultraviolet light source from irradiating other parts in the casing 11 and aging the corresponding parts.

In one embodiment, the reflector 13 is located on the air inlet path of the fan 15, and the reflector 13 is provided with an air flow hole 133, so that air enters the reflector 13 through the window 113, and then enters the fan 15 from the air flow hole 133. In this way, the lamp socket 121 and the ultraviolet light source in the reflector 13 can be dissipated to improve the service life of the ultraviolet light source and the lamp socket 121, and after the air enters the reflector 13, it will be heated by the ultraviolet light source, so that the heat produced by the ultraviolet light source is used, which improves energy utilization and reduces power consumption. The reflector 13 is provided to improve the utilization of the light emitted by the ultraviolet light source. The reflector 13 is arranged on the air inlet path of the fan 15 and the air flow holes 133 are provided on the reflector 13, and the air flow will enter the fan 15 through the reflector 13, then is blown out, so that the ultraviolet light source can be dissipated and cooled, and the service life of the ultraviolet light source can be increased, and the heat generated by the ultraviolet light source can be used to heat the inlet air flow of the fan 15, which improves energy utilization and reduces energy consumption.

In one embodiment, referring to FIGS. 1 and 4, the casing 11 comprises a bottom plate 111 and a cover 112 covering the bottom plate 111, and the window 113 and the air outlet 114 are provided on the bottom plate 111. The casing 11 is easy to process, and it is also convenient for the lamp socket 121, the ultraviolet lamp tube 122, the reflector 13, the heater 14 and the fan 15 to be installed in the casing 11. In one embodiment, the bottom plate 111 constitutes the bottom of the casing 11. Of course, in other embodiments, when the lower end of the cover 112 is arranged around the bottom plate 111, the lower end of the circumference of the cover 112 and the bottom plate 111 together form the bottom of the casing 11. In some embodiments, the casing 11 may also be formed by a combination of a plurality of plates.

In one embodiment, the front side of the casing 11 is provided with a control panel 110, and the control panel 110 is inclined to the inside of the casing 11 from top to bottom, to facilitate the user's operation and the determination of position of the control panel 110 by the user. In one embodiment, the control panel 110 is provided on the cover 112 to facilitate processing and manufacturing.

In one embodiment, the window 113 is located at a corresponding position on the rear side of the bottom of the casing 11, so that when in use, the window 113 is closer to the wall 900, and the UV lamp tube 122 is also closer to the wall 900 to better limit the range of ultraviolet light and improve safety.

In one embodiment, referring to FIGS. 1 to 3, a hook 1121 is provided on the rear side of the casing 11, so that the casing 11 can be installed on the wall 900 by hooking, which is convenient for installation and fixing. Of course, in some other embodiments, the casing 11 can also be installed on the wall 900 by screws.

In one embodiment, a wire concealing groove 1122 is provided on the rear side of the casing 11 so that the power cord can be put in the wire concealing groove 1122.

In one embodiment, referring to FIGS. 4 to 6, the heater 14 may be arranged at the inlet of the fan 15, and the air is heated by the heater 14, and then sucked and accelerated by the fan 15 and then blown out. Since the air flow velocity at the inlet of the fan 15 is relatively small, the gas can be fully heated by the heater 14 first, then enters the fan 15, so the heat utilization rate is high, and the power of the corresponding heater 14 can be low. In other embodiments, the heater 14 may also be arranged at the outlet of the fan 15, and the air flow blown by the fan 15 is heated by the heater 14, and then flows out.

In one embodiment, referring to FIGS. 4 and 6, the reflector 13 has an air flow hole 133 on the side close to the fan 15, so that after air enters the reflector 13, it can enter the fan 15 through the air flow hole 133 easily, which reduces air resistance. Of course, in other embodiments, air flow holes 133 may be provided on both sides of the reflector 13 respectively. In some other embodiments, an air flow hole 133 may be provided on the side of the reflector 13 away from the fan 15.

In one embodiment, the ultraviolet lamp tube 122 can be detachably installed on the lamp socket 121, so that it is easy to replace the ultraviolet lamp tube 122.

In one embodiment, referring to FIG. 6, the reflector 13 comprises two reflective side plates 132 and a supporting plate 131, and the air flow hole 133 is provided on the reflective side plate 132. The supporting plate 131 is connected to the upper side of the two reflective side plates 132. When in use, the two reflective side plates 132 are located on both sides of the lamp socket 121, and when the ultraviolet lamp tube 122 is installed on the lamp socket 121, the two reflective side plates 132 are located on both sides of the ultraviolet lamp tube 122 to reflect light. The distance between the two reflective side plates 132 is gradually expanded from the supporting plate 131 to the direction away from the supporting plate 131, so that on the one hand, the light emitted by the ultraviolet lamp tube 122 can be reflected, and the reflected light can also be guaranteed to cover a larger area.

In one embodiment, the reflector 13 may be stamped from a metal plate to facilitate processing and manufacturing. In addition, the reflector 13 may also be used to dissipate heat from the ultraviolet lamp tube 122. Of course, in some embodiments, the reflector 13 may also be a plastic cover, and a reflective coating is provided on the inner surface of the plastic cover.

In one embodiment, the lower end of the reflective side plate 132 may be fixed to the bottom of the casing 11 to install the reflector 13 in the casing 11.

In one embodiment, the supporting plate 131 of the reflector 13 can be fixedly connected to the lamp socket 121 which is fixed in the casing 11 to support the reflector 13 by the lamp socket 121.

In some other embodiments, the lower end of the reflective side plate 132 can be fixed to the bottom of the casing 11, and the supporting plate 131 of the reflector 13 can be fixedly connected to the lamp socket 121 to guarantee the installation stability of the reflector 13.

In one embodiment, referring to FIGS. 4 and 6, the fan 15 comprises a wind hood 151, a tubular wind wheel 152, and a motor 153. The motor 153 is connected to the tubular wind wheel 152 to drive the tubular wind wheel 152 to rotate by the motor 153. The tubular wind wheel 152 is installed in the wind hood 151, and the air flow is guided by the wind hood 151. By using the tubular wind wheel 152, the volume can be made smaller and the air volume can be large, so that the main machine 10 can be made smaller. Of course, in other embodiments, other fan 15 structures can also be used.

In one embodiment, the heater 14 is arranged between the fan 15 and the reflector 13, and the heater 14 is located at the inlet of the fan 15, so that after the air is preheated by the reflector 13, it enters the heater 14 for heating, and then enters the fan 15. This structure can better heat the air, improve the energy utilization rate, and can make the power the heater 14 smaller.

In one embodiment, referring to FIGS. 4 to 6, the air inlet 115 is located at the position corresponding to the heater 14, so that a part of the air will pass through the reflector 13 to the fan 15, and the other part of the air can enter directly from the bottom of the casing 11 to the heater for heating, which will reduce air resistance and guarantee that the fan 15 has sufficient air output.

In one embodiment, referring to FIGS. 4 to 6, the main machine 10 further comprises a grille window 123. The grille window 123 is detachably installed on the bottom of the casing 11 and covered on the opening window 113 to protect the ultraviolet lamp tube 122 in the reflector 13, and the grille window 123 can transmit light and ventilate.

In one embodiment, the grille window 123 may use a light-transmitting material, so that the light emitted by the ultraviolet lamp tube 122 can be emitted through the grille window 123 to improve the utilization rate of light.

In one embodiment, the heater 14 comprises a heating plate 141 and a plurality of heat dissipating fins 142, and the plurality of heat dissipating fins 142 are arranged on the heating plate 141 to heat the air more efficiently and quickly. The use of the heating plate 141 provides high safety. Of course, in some other embodiments, the heater 14 may also use heating wires, heating tubes, etc.

In one embodiment, the main machine 10 further comprises a wind guiding window 16 installed in the air outlet 114 to guide the air flow to diffuse, that is, when the air flow blown by the fan 15 passes through the wind guiding window 16, it will be guided to diffuse by the wind guiding window 16 to better heat and dry the fabric.

In one embodiment, the wind guiding window 16 may use shutters. In some other embodiments, the wind guiding window 16 may also use a guide plate to guide the air flow to diffuse.

Figure 7:
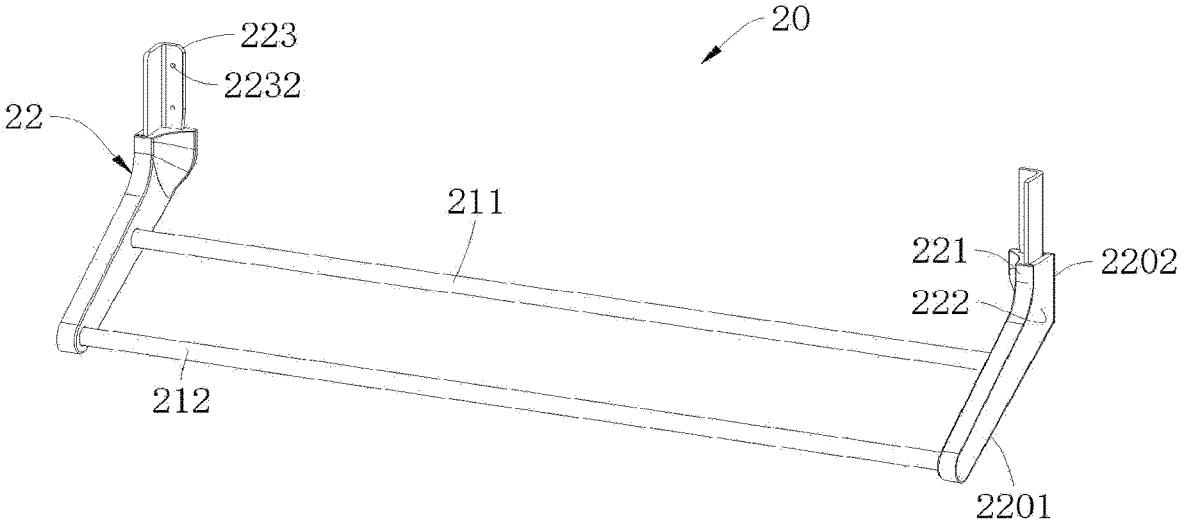
FIG. 7 is a structural schematic diagram of the hanger in FIG. 1.

In one embodiment, referring to FIGS. 1, 5, and 7, there are at least two hanging rods 211, and two adjacent hanging rods 211 are arranged in parallel, so that more fabrics such as towels can be put.

In one embodiment, referring to FIGS. 4, 5 and 7, the supporting section 2201 is inclined downward from the rear side of the casing 11 to the front side of the casing 11, that is, the height of the rear end of the supporting section 2201 is greater than that of the front end of the supporting section 2201, and the structure can make the placement of fabrics such as towels on the hanging rod 211 easy.

In one embodiment, in the two adjacent hanging rods 211: the height of the hanging rod 211 near the front side of the casing 11 is lower than that of the hanging rod 211 near the rear side of the casing 11, so that the distance between the front hanging rod 211 and the casing 11 is relatively large, while the distance between the rear hanging rod 211 and the casing 11 is relatively small, so that the placement of fabrics on the hanging rod 211 is easy.

In one embodiment, the angle between the supporting section 2201 of the support 22 and the horizontal direction is in the range of 10-45 degrees, so that a good height difference can be formed between two adjacent hanging rods 211 supported by the two supporting sections 2201, and there is a large spacing in the horizontal direction to make the placement of fabrics on the hanging rod 211 easy. However, the angle between the supporting section 2201 and the horizontal direction is less than 10 degrees, which results in a small height difference between two adjacent hanging rods 211, and it is difficult to put fabrics on the hanging rod 211. However, when the angle between the supporting section 2201 and the horizontal direction is greater than 45 degrees, the height difference between the two adjacent hanging rods 211 is too large, the reinforced towel dryer 100 will occupy a large space, so the main machine 10 needs to be installed at a high place, and two adjacent hanging rods 211 will be too close in the horizontal direction, making the fabrics on two adjacent hanging rods 211 overlap with each other.

In one embodiment, the hanger 20 further comprises a supporting rod 212, and the two ends of the supporting rod 212 are respectively connected to the front ends of the two supporting sections 2201. Of course, in some embodiments, when there are a plurality of hanging rods 211, the hanging rod 211 located at the front end of the supporting section 2201 may be used as the supporting rod 212.

In one embodiment, a plug-in hole 2209 may be provided at the front end of the supporting section 2201 of the support 22, so that both ends of the supporting rod 212 are inserted into the corresponding plug-in holes 2209 to support the supporting rod 212, which is convenient for assembly. Of course, in other embodiments, the supporting rod 212 can also be installed on the supporting section 2201 in the same structure as the hanging rod 211.

Figure 8:
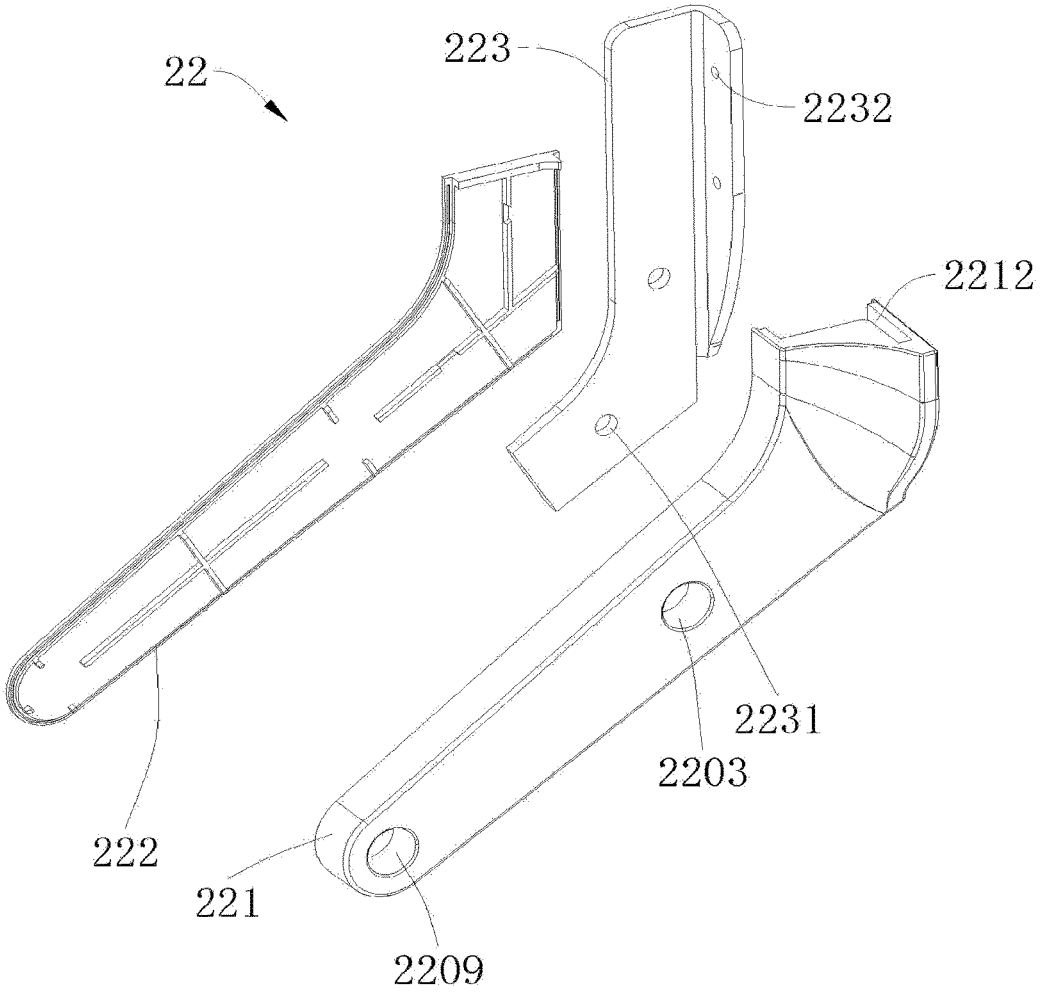
FIG. 8 is a schematic diagram 1 of the exploded structure of the support in FIG. 7.

In one embodiment, referring to FIGS. 5, 7 and 8, a reinforcing plate 223 is installed on each support 22, the lower end of the reinforcing plate 223 is fixed in the vertical section 2202, and the upper end of the reinforcing plate 223 is fixedly connected to the rear side of the casing 11, and a reinforcing plate 223 is provided to increase the strength of the support 22, so that the fabrics can be hung better, and it is also convenient to fix the support 22 on the casing 11.

In one embodiment, the two ends of the rear side of the bottom of the casing 11 are respectively provided with connecting holes 116, that is, the two ends of the bottom of the casing 11 are respectively provided with connecting holes 116, and the connecting holes 116 are located on the rear side of the bottom of the casing 11. The upper end of the reinforcing plate 223 is inserted into the corresponding inserting hole 116 to fix the reinforcing plate 223 with the casing 11, and then the support 22 and the casing 11 are fixedly connected.

Figure 9:
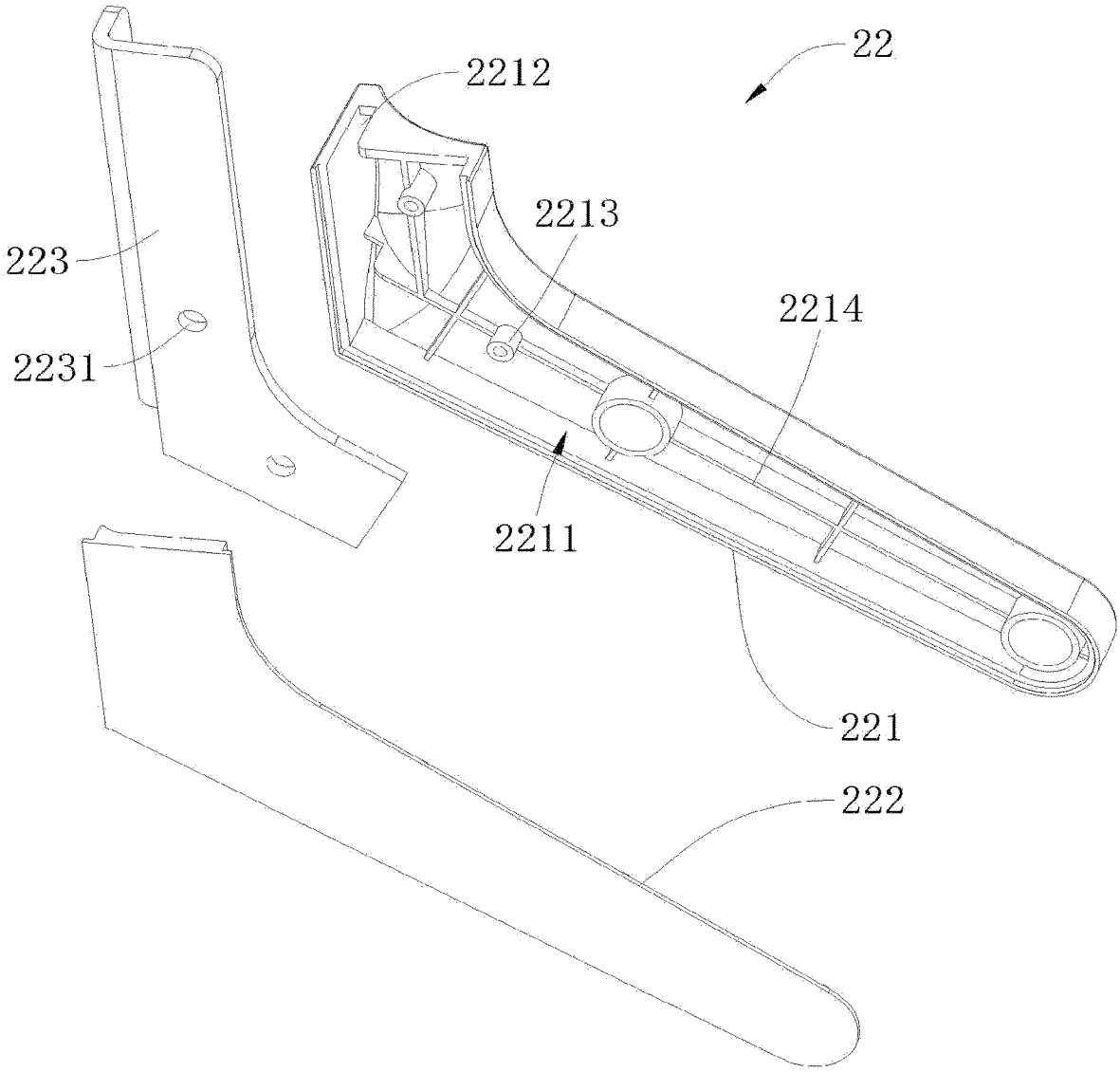
FIG. 9 is a schematic diagram 2 of the exploded structure of the support in FIG. 7.

In one embodiment, referring to FIGS. 5, 8 and 9, a mounting hole 2232 is provided on the reinforcing plate 223 to be fixedly connected to the rear side wall of the cover 112.

In one embodiment, the lower end of the reinforcing plate 223 extends into the supporting section 2201 to guarantee the good strength of the support 22. In addition, since the supporting section 2201 is arranged obliquely to the vertical section 2202, the reinforcing plate 223 and the support 22 are more firmly connected.

In one embodiment, the cross section of the reinforcing plate 223 is L-shaped, which can guarantee the good strength of the reinforcing plate 223, and the two corners of the rear side of the bottom of the casing 11 are respectively provided with connecting holes 116, the cross section of each connecting hole 116 is L-shaped, so that the reinforcing plate 223 can be positioned and fixed.

In one embodiment, the two corners of the rear side of the bottom plate 111 of the casing 11 may be provided with connecting holes 116, so that when the reinforcing plate 223 is inserted into the corresponding connecting holes 116, it can be connected to the rear side wall of the cover 112 of the casing 11.

In one embodiment, inserting slots can be provided on both ends of the casing 11 near the rear side of the casing 11, and the inserting slots extend to the bottom of the casing 11, and the upper end of the reinforcing plate 223 is inserted into this inserting slot to fix. Of course, it is also possible to provide an inserting slot on the rear side of the casing 11 and extend the inserting slot to the bottom of the casing 11, and insert the upper end of the reinforcing plate 223 into the inserting slot to fix the reinforcing plate 223.

In one embodiment, referring to FIGS. 8 and 9, the support 22 comprises a fixing shell 221 and a cover shell 222. The fixing shell 221 is provided with an accommodating cavity 2211, and the lower end of the reinforcing plate 223 is put in the accommodating cavity 2211, The fixing shell 221 is provided with an aperture 2212, the upper end of the reinforcing plate 223 protrudes from the aperture 2212 of the fixing shell 221, and the cover shell 222 covers the fixing shell 221 to cooperate with the fixing shell 221 to fix the reinforcing plate 223. The structure of the support 22 is convenient for processing, and is easy to install on the fixed reinforcing plate 223.

In one embodiment, the supporting section 2201 of the support 22 is provided with a supporting hole 2203 for positioning and supporting the hanging rod 211. Specifically, a supporting hole 2203 may be provided on the fixing shell 221 to support the hanging rod 211.

In one embodiment, the accommodating cavity 2211 of the fixing shell 221 is provided with a positioning column 2213, the reinforcing plate 223 is provided with a positioning hole 2231, and the positioning column 2213 is inserted into the positioning hole 2231, that is, the reinforcing plate 223 can be positioned. When the cover shell 222 is connected to the fixing shell 221, the reinforcing plate 223 can be fixed in the fixing shell 221.

In one embodiment, the accommodating cavity 2211 of the fixing shell 221 is provided with reinforcing ribs 2214 to guarantee the good strength of the fixing shell 221, and the weight of the support 22 and the cost can also be reduced.

In one embodiment, a metal plate may be used for the reinforcing plate 223 to guarantee good strength of the reinforcing plate 223. Of course, in some embodiments, the reinforcing plate 223 can also be made of other materials with high strength.

In some embodiments, the reinforcing plate 223 and the support 22 may be injection molded into an integral structure to guarantee the connection strength between the support 22 and the reinforcing plate 223.

Figure 10:
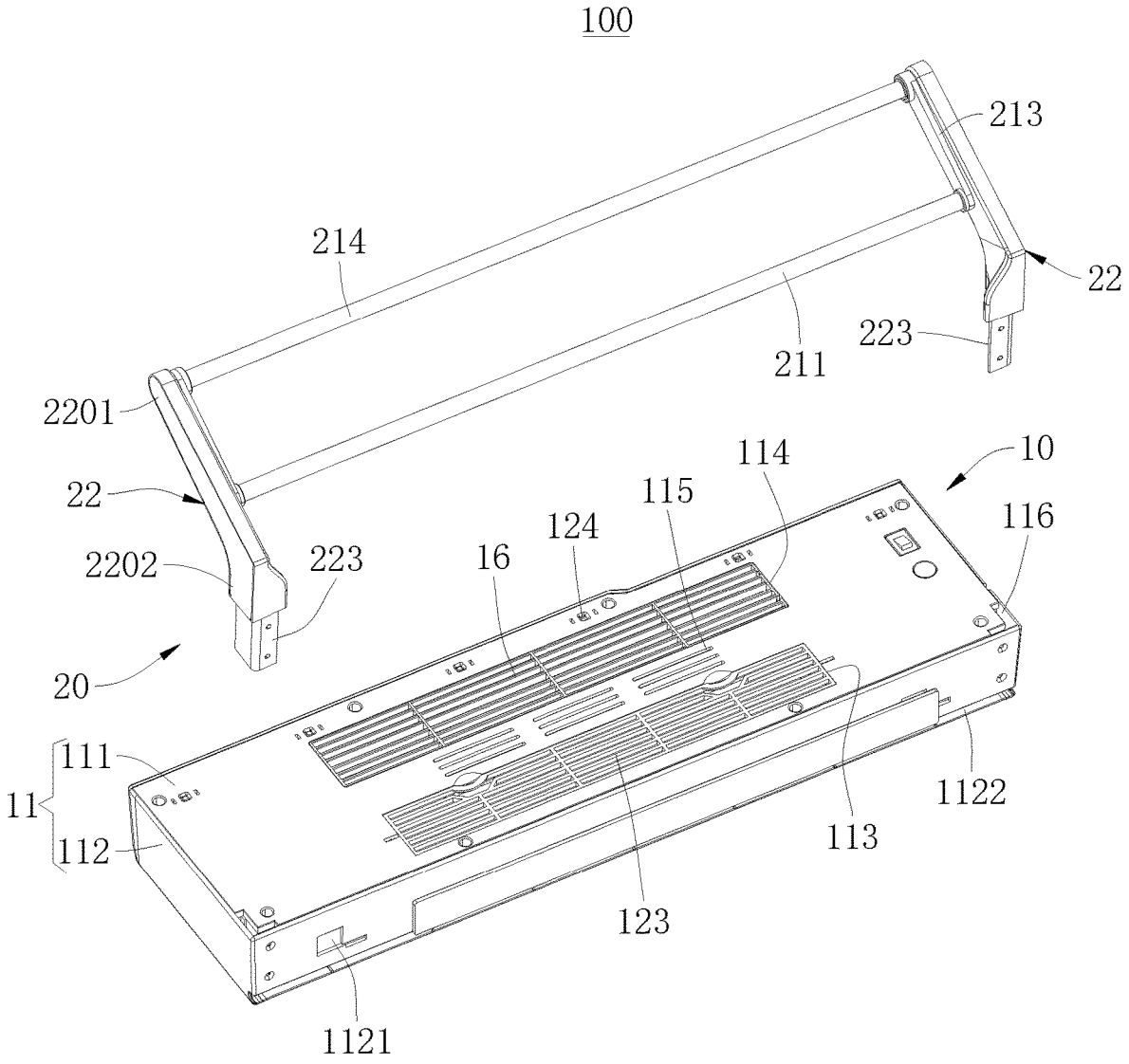
FIG. 10 is a schematic diagram of an exploded structure of a reinforced towel dryer provided in embodiment 2 of the application.
Figure 11:
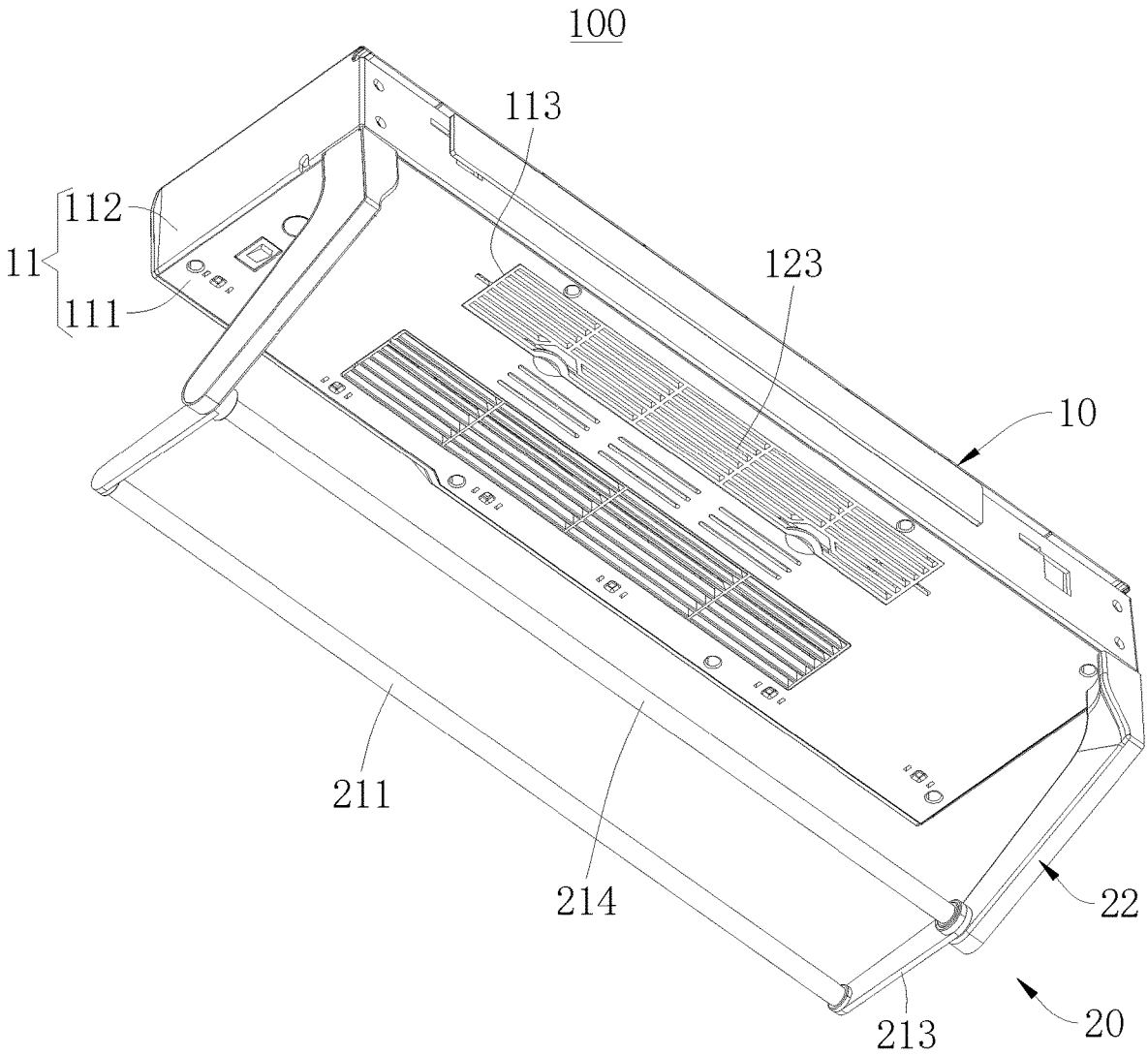
FIG. 11 is a structural schematic diagram of a reinforced towel dryer in FIG. 10 after the hanging rod is turned forward.
Figure 12:
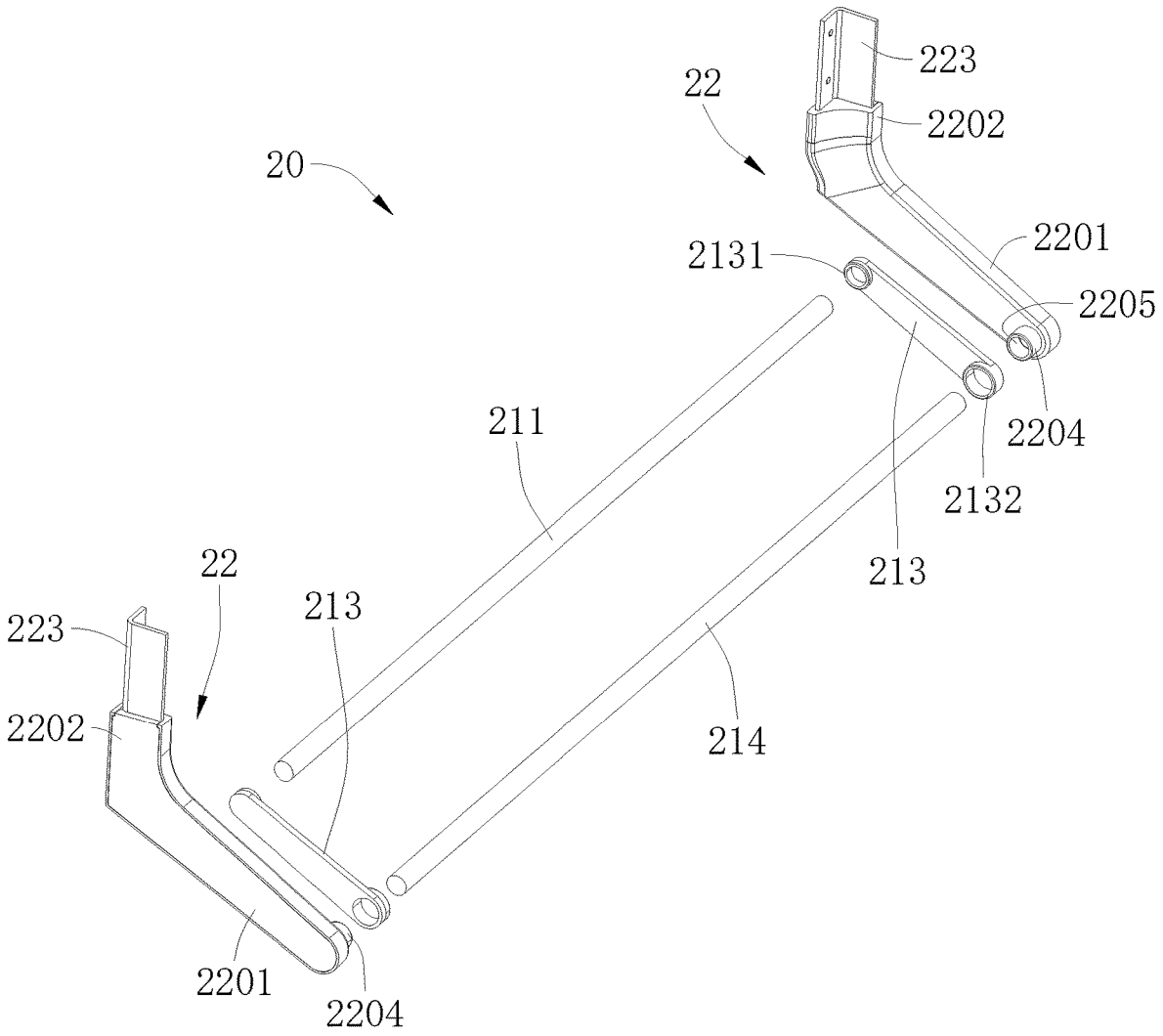
FIG. 12 is a schematic diagram of the exploded structure of the hanger in FIG. 10.

In some embodiments, referring to FIGS. 10, 11 and 12, the hanger 20 further comprises two supporting arms 213. The two supporting arms 213 respectively support two ends of the hanging rod 211, and one end of each supporting arm 213 is rotatably connected to the support 22, so that the hanging rod 211 is rotatably installed on the support 22. The supporting section 2201 of each support 22 extends from back to front, that is, the supporting section 2201 extends from the rear side of the casing 11 toward the front side of the casing 11. One end of each supporting arm 213 is rotatably connected to the front end of the corresponding supporting section 2201, and the corresponding area of the other end of each supporting arm 213 is connected to the hanging rod 211, that is, each supporting arm 213 is connected to the hanging rod 211 at the position near the other end of the supporting arm 213. In this way, when the supporting arm 213 is rotated, the hanging rod 211 can be driven to rotate; since one end of the supporting arm 213 is rotatably connected to the front end of the supporting section 2201, when the supporting arm 213 is rotated forward, the hanging rod 211 can be turned over to the front side of the main machine 10, which is convenient for picking and placing the fabrics; and when the supporting arm 213 is rotated backward, the hanging rod 211 can be located under the main machine 10, to sterilize the fabrics on the hanging rod 211.

Figure 13:
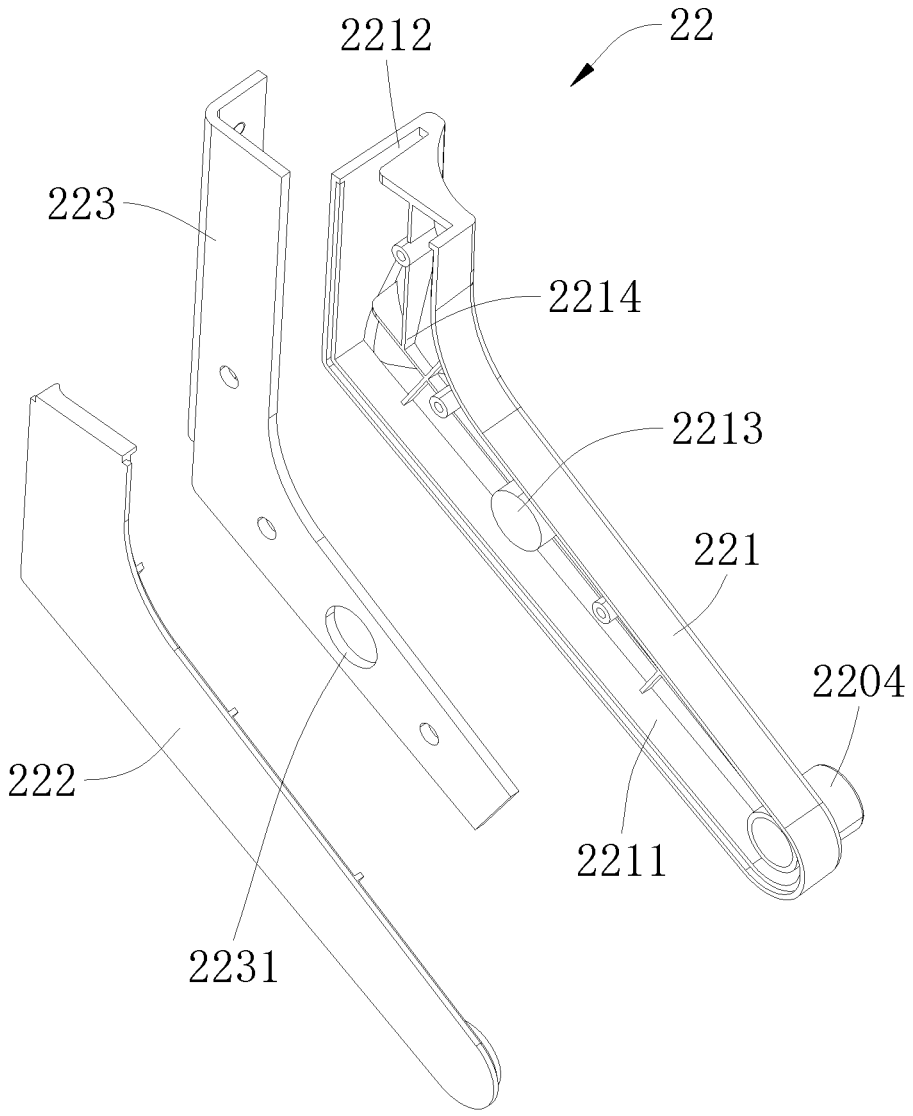
FIG. 13 is a schematic diagram 1 of the exploded structure of the support in FIG. 12.
Figure 14:
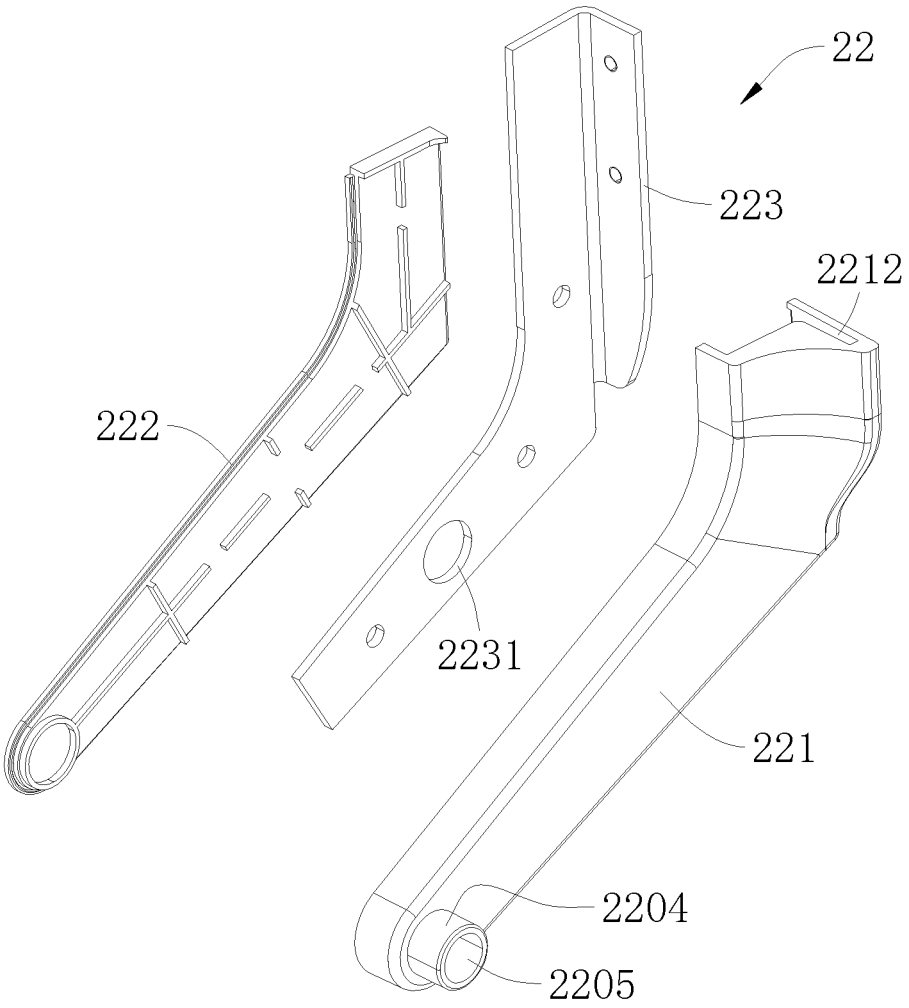
FIG. 14 is a schematic diagram 2 of the exploded structure of the support in FIG. 12.

In one embodiment, referring to FIGS. 12 to 14, the front end of each supporting section 2201 is provided with a rotating shaft 2204, each supporting arm 213 is provided with a damping sleeve 2132 sleeved on the rotating shaft 2204, so that frictional resistance can be generated between the damping sleeve 2132 and the rotating shaft 2204, the supporting arm 213 can be positioned on the rotating shaft 2204, and the hanging rod 211 can stably support the fabrics. In other embodiments, a friction plate can also be installed in the support 22 to hold against the supporting arm 213, thereby increasing the friction resistance. In still other embodiments, the supporting arm 213 may be connected to the supporting section 2201 by a ratchet, so as to position the supporting arm 213 by the ratchet.

In one embodiment, referring to FIGS. 12 to 14, each rotating shaft 2204 is provided with a shaft hole 2205, the hanger 20 further comprises a fulcrum bar 214, and both ends of the fulcrum bar 214 are respectively put in the shaft holes 2205 of the corresponding shaft 2204. Therefore, the fabrics can be supported by the fulcrum bar 214, so that more fabrics can be supported on the hanger 20.

In one embodiment, the number of the hanging rod 211 is one, and the hanging rod 211 is located at the other end of the supporting arm 213. This structure can keep the hanging rod 211 away from the fulcrum bar 214, so that it is convenient to pick up and put the fabrics on the hanging rod 211 and the fulcrum bar 214. Of course, the number of hanging rods 211 can also be two or three, and the two ends of each hanging rod 211 are respectively fixedly connected to two supporting arms 213, so as to support more fabrics. The number of hanging rods 211 can be set according to the width of the main machine 10 in the front and rear direction.

In one embodiment, referring to FIGS. 12 to 14, each supporting arm 213 is provided with a fixing sleeve 2131, and the end of the hanging rod 211 is inserted into the corresponding fixing sleeve 2131 to connect and fix the hanging rod 211 by the fixing sleeve 2131, so it is convenient to connect the hanging rod 211 and the supporting arm 213.

Figure 15:
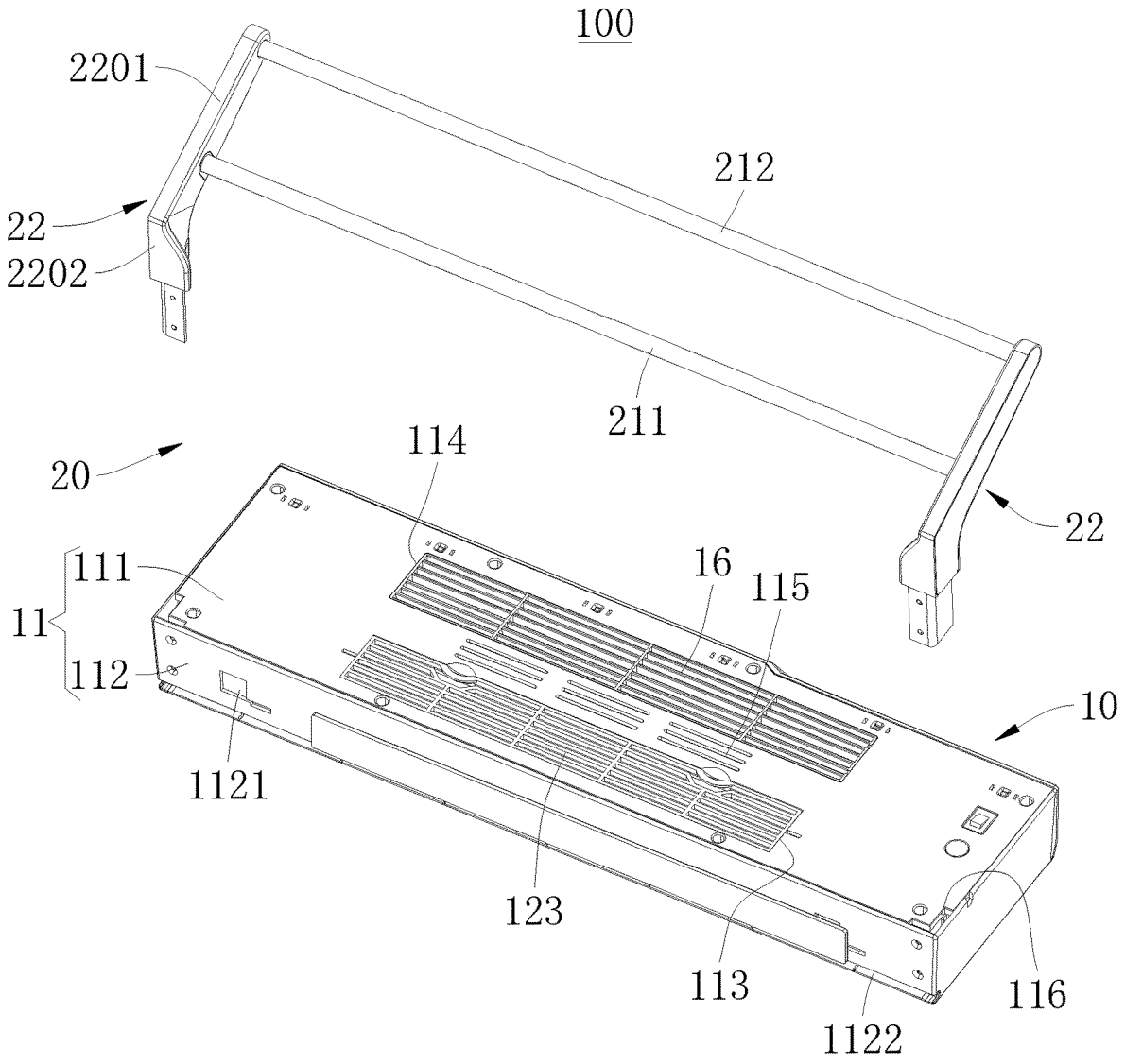
FIG. 15 is a schematic diagram of the exploded structure of a reinforced towel dryer provided in embodiment 3 of the application.
Figure 16:
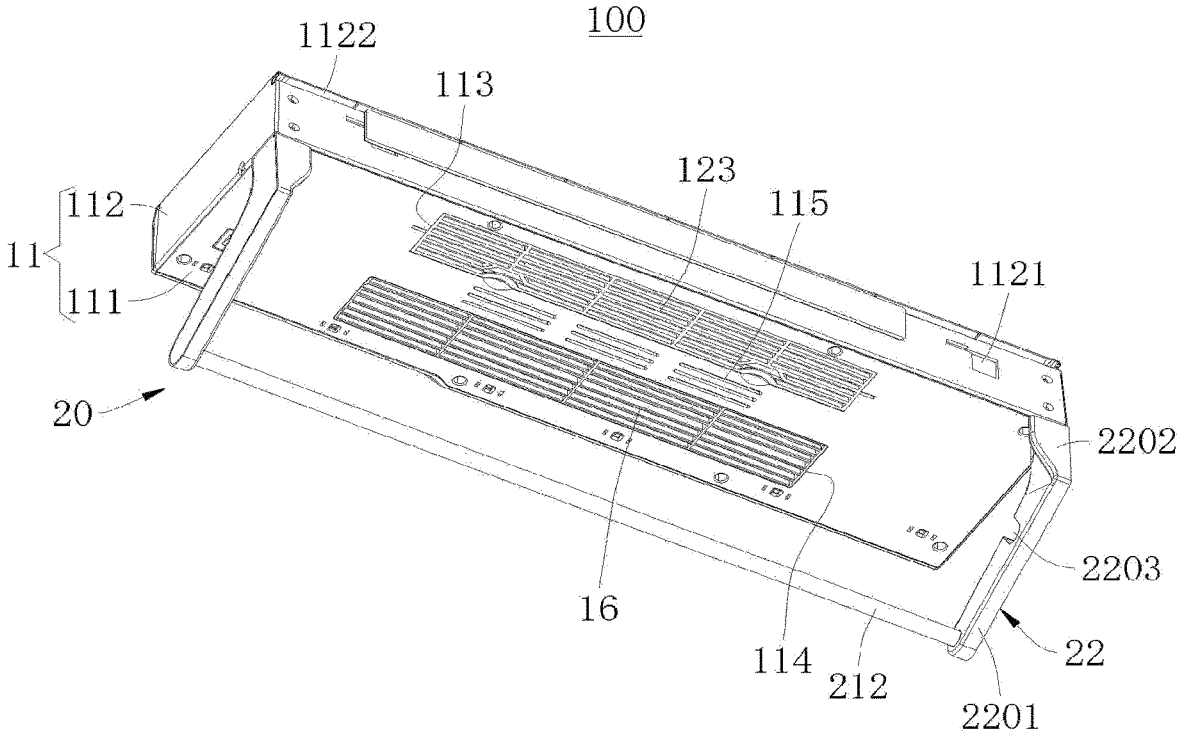
FIG. 16 is a structural schematic diagram of the window of a reinforced towel dryer in FIG. 15 after the corresponding hanging rod is removed.
Figure 17:
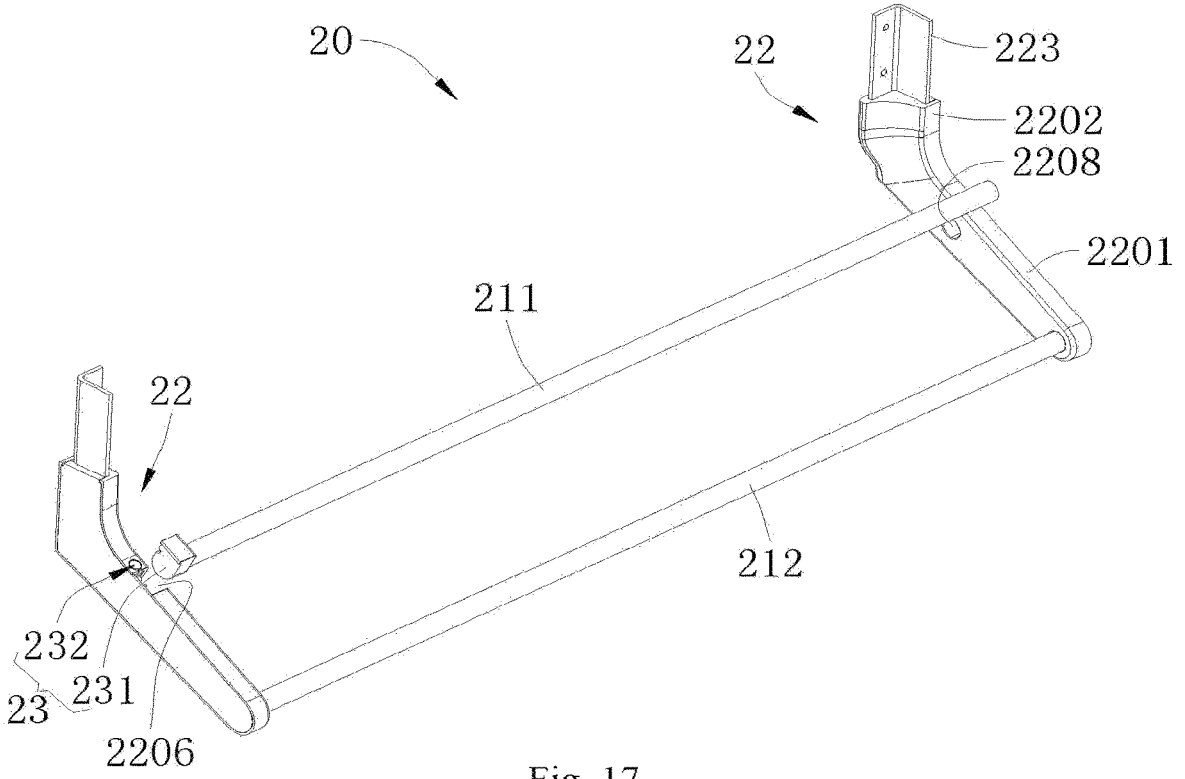
FIG. 17 is a schematic diagram of the exploded structure of the hanger in FIG. 15.

In one embodiment, referring to FIGS. 15, 16 and 17, the hanging rod 211 is located at a corresponding position under the window 113. The hanging rod 211 can be detachably installed on the support 22, so when replacing the ultraviolet light source, the hanging rod 211 can be disassembled first to avoid the hanging rod 211 influencing the replacement of the ultraviolet light source, which is convenient to use.

Figure 18:
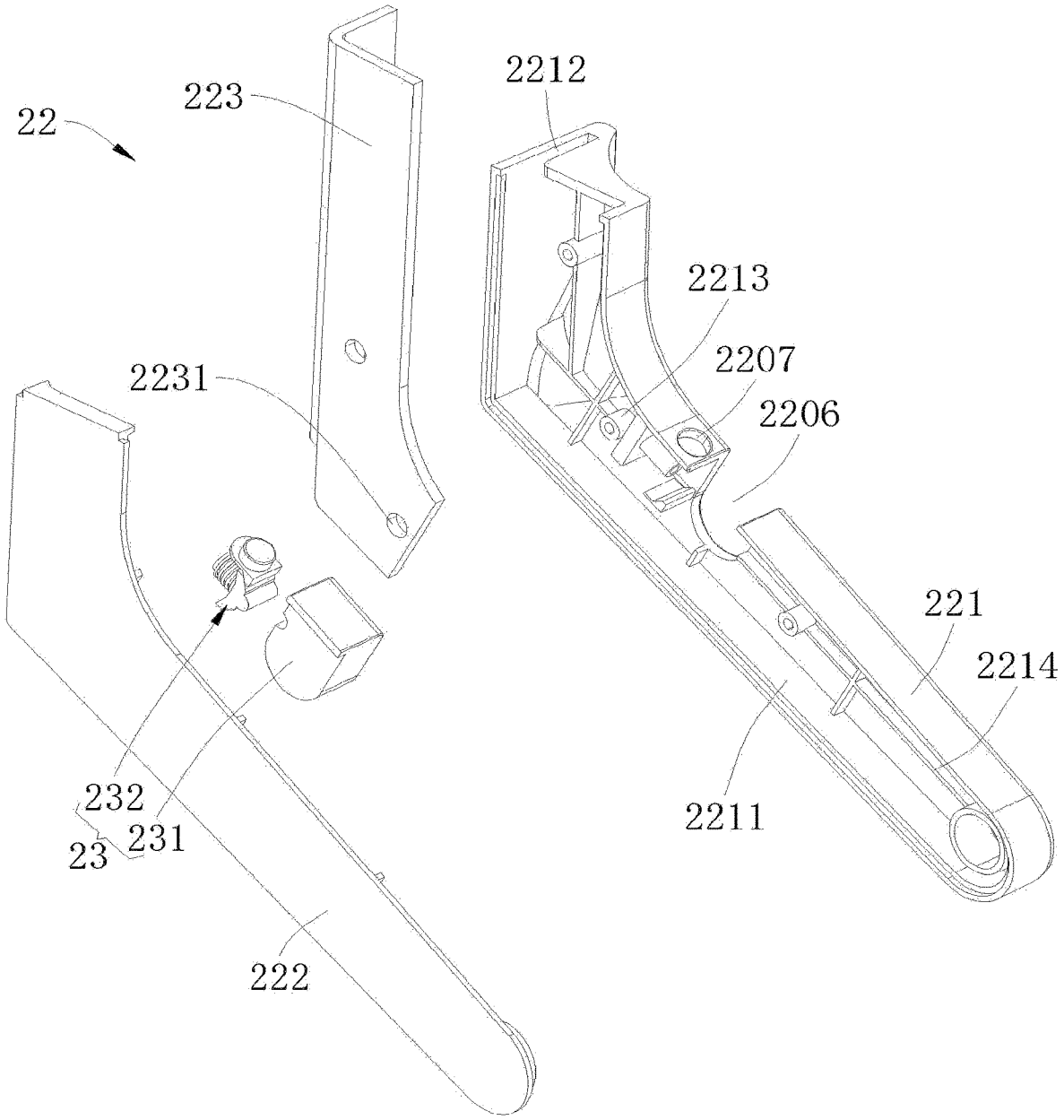
FIG. 18 is a schematic diagram 1 of an exploded structure of the support and locking mechanism in FIG. 17.

In one embodiment, referring to FIGS. 17 and 18, one support 22 is provided with a supporting groove 2206, and the other support 22 is provided with an inserting hole 2208, and one end of the hanging rod 211 can be inserted into the inserting hole 2208, the other end is put in the supporting groove 2206, so that the hanging rod 211 is supported by the two supports 22, which is convenient for installation and easy to remove the hanging rod 211. In other embodiments, the two supports 22 may be provided with supporting grooves 2206, and the two ends of the hanging rod 211 are put in the two supporting grooves 2206 respectively, and the hanging rod 211 can be supported on the two supports 22, which is convenient to assemble.

Figure 19:
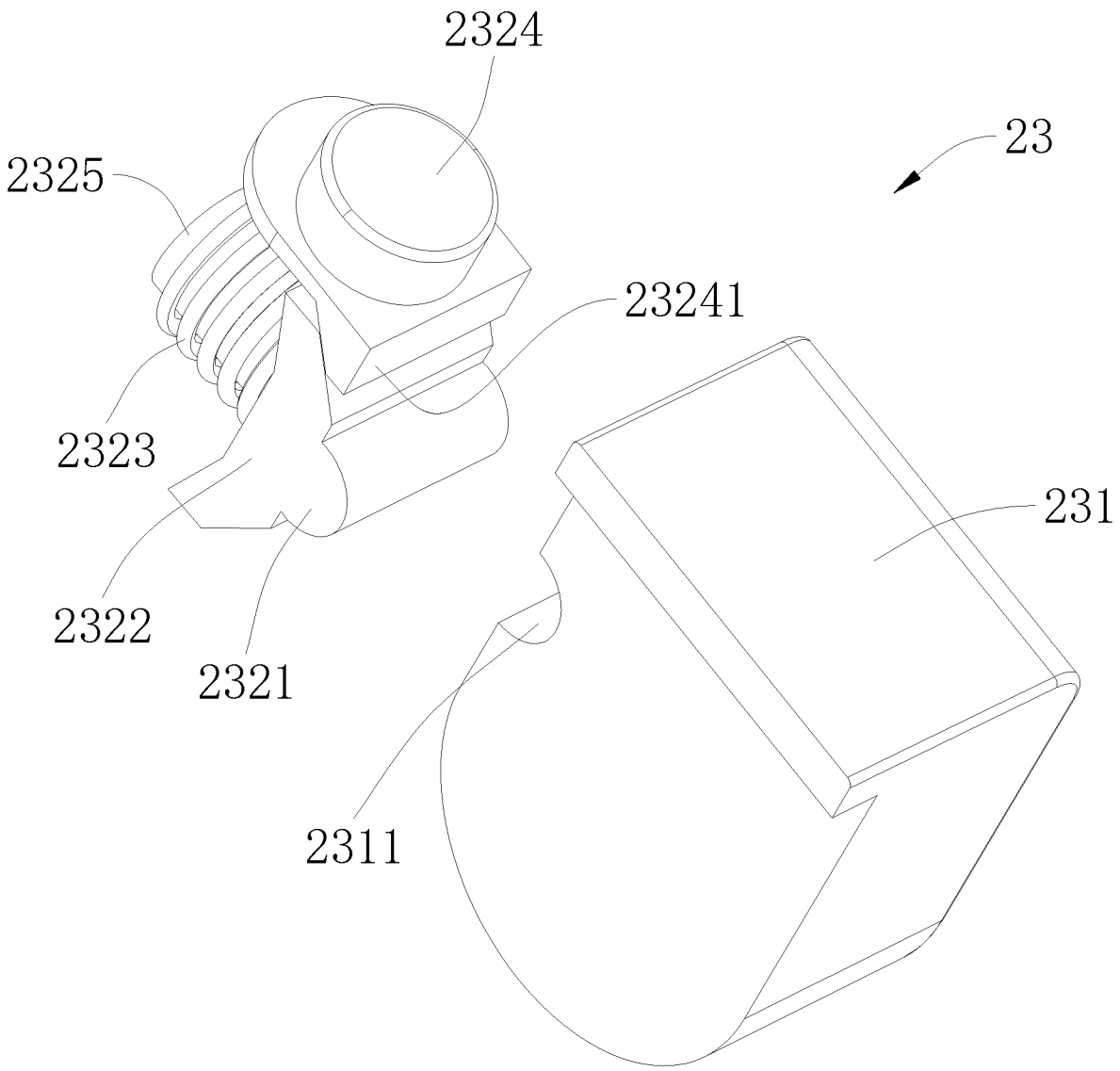
FIG. 19 is a structural schematic diagram of the locking mechanism in FIG. 18.
Figure 20:
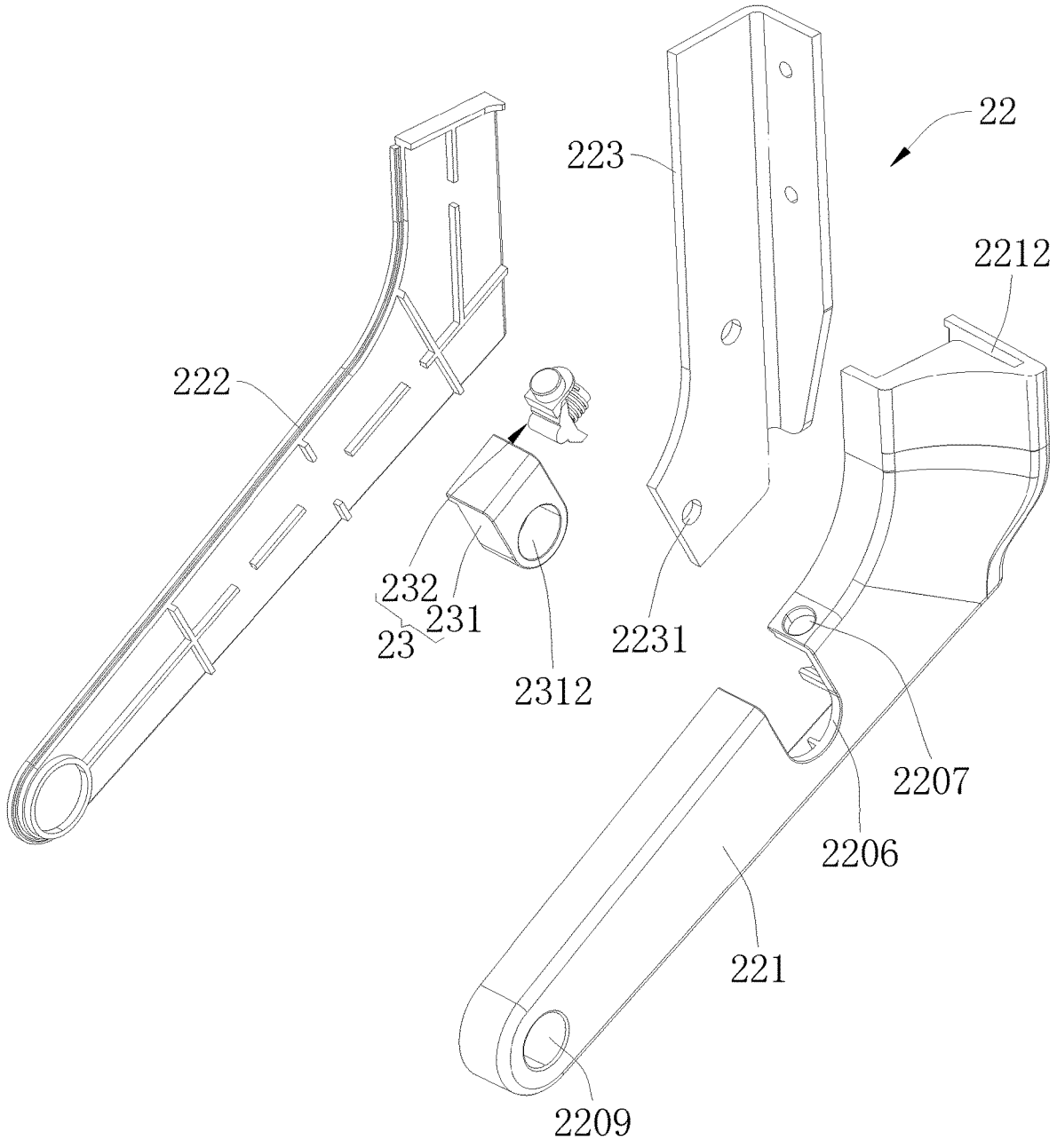
FIG. 20 is a schematic diagram 2 of the exploded structure of the support and the locking mechanism in FIG. 17.

In one embodiment, referring to FIGS. 17 to 19, the hanger 20 further comprises a locking mechanism 23 installed on the support 22, the locking mechanism 23 is used to position the end of the hanging rod 211 in the corresponding supporting groove 2206 to prevent the hanging rod 211 from falling.

In one embodiment, the locking mechanism 23 comprises an inserting block 231 and a positioning component 232. The end of the hanging rod 211 is fixedly connected to the inserting block 231. The positioning component 232 is installed in the support 22, and the inserting block 231 is inserted into the supporting groove 2206, the end of the hanging rod 211 is put in the supporting groove 2206, and the positioning component 232 elastically presses against the inserting block 231 to lock the inserting block 231 in the supporting groove 2206, thereby locking the end of the hanging rod 211.

Of course, in other embodiments, the locking mechanism 23 may also be a sliding plate slidably installed on the support 22, and the sliding plate is covered in the supporting groove 2206 by moving the sliding plate to lock the end of the hanging rod 211 in the supporting groove 2206. In some other embodiments, the locking mechanism 23 may also be a stop bar for stopping the hanging rod 211. The stop bar is rotatably installed in the support 22, so that when the stop bar is covered on the supporting groove 2206, the hanging bar 211 can be prevented from falling off from the supporting groove 2206. When the stop bar is moved away from the supporting groove 2206, the hanging rod 211 can be removed from the supporting groove 2206.

In one embodiment, a clamping slot 2311 is provided on the inserting block 231. The positioning component 232 comprises a top protrusion 2321, a supporting block 2322, an elastic member 2323 and a button 2324. The top protrusion 2321 is used to fit into the clamping slot 2311 to position the inserting block 231. The top protrusion 2321 is installed on the supporting block 2322, and the top protrusion 2321 is fixedly supported by the supporting block 2322. The elastic member 2323 elastically presses against the supporting block 2322 toward the inserting block 231, so as to push the top protrusion 2321 to extend into the clamping slot 2311. The support 22 is provided with an opening 2207 exposing the button 2324. The button 2324 is used to push the supporting block 2322 to move in the direction away from the inserting block 231 to unlock the inserting block 231.

In other embodiments, the positioning component 232 can also use marbles to position and lock the insert 231 by the marbles.

In one embodiment, the inserting block 231 is provided with a fixing hole 2312, and the end of the hanging rod 211 is put in the fixing hole 2312, so that the inserting block 231 is connected to the hanging rod 211. Of course, in some embodiments, the inserting block 231 may also be fixed on the hanging rod 211 by welding or injection molding.

In one embodiment, the elastic member 2323 is a spring, the supporting block 2322 is further provided with a positioning shaft 2325, the spring is sleeved on the positioning shaft 2325. The positioning shaft 2325 and the top protrusion 2321 are respectively located on opposite sides of the supporting block 2322 to stabilize and support the spring. In other embodiments, the elastic member may also be an elastic sheet.

In one embodiment, the upper end surface of the supporting block 2322 can be inclined, and the corresponding button 2324 is provided with a pushing block 23241 that cooperates to push the supporting block 2322 to move away from the inserting block 231, so that the button 2324 can be pressed down to push the supporting block 2322 move away from the inserting block 231.

The reinforced towel dryer 100 of the embodiment of the present application has small size, large air volume, low energy consumption, high energy utilization, long service life, low cost, low weight and high strength.

The above are only optional embodiments of this application and are not intended to limit this application. Any modification, equivalent replacement and improvement made within the spirit and principle of this application shall be comprised in the protection scope of this application.

What is claimed is:

1. A reinforced towel dryer, comprising:

a main machine, comprising:

a casing, a bottom of the casing being provided with an air outlet and an air inlet, a fan, installed in the casing, and the air outlet of the casing being corresponding to the outlet of the fan, and a heater, installed in the casing, and arranged in are air flow path of the fan, and a hanger for hanging fabrics, comprising:

a hanging rod with two ends, and two supports respectively supporting the two ends of the hanging rod, each support having:

a supporting section, configured for supporting one of the two ends of the hanging rod, and a vertical section, configured for abutting against a wall when the casing is installed on the wall, a lower end of the vertical section being connected to a rear end of the supporting section, and an upper end of the vertical section being fixedly connected to a rear side of the casing, and the lower end of the vertical section forming a fulcrum with the wall when fabrics are put on the hanging rod.

2. The reinforced towel dryer according to claim 1, wherein the supporting section is inclined downwardly from the rear side of the casing to a front side of the casing.

3. The reinforced towel dryer according to claim 2, wherein an angle between the supporting section and a horizontal direction ranges from 10-45 degrees.

4. The reinforced towel dryer according to claim 1, wherein a reinforcing plate is installed on each of the two supports, a lower end of the reinforcing plate is fixed in the vertical section, and an upper end of the reinforcing plate is fixedly connected to the rear side of the casing.

5. The reinforced towel dryer according to claim 4, wherein two ends of a rear side of the bottom of the casing are respectively provided with connecting holes, and the upper end of the reinforcing plate is inserted into a corresponding connecting hole.

6. The reinforced towel dryer according to claim 5, wherein two corners of the rear side of the bottom of the casing are respectively provided with the connecting holes, a cross section of each connecting holes is L-shaped, and a cross section of the reinforcing plate is L-shaped.

7. The reinforced towel dryer according to claim 4, wherein inserting slots are provided on two ends of the casing near the rear side of the casing, or inserting slots are provided on the rear side of the casing, the inserting slots extend to the bottom of the casing, and the upper end of the reinforcing plate is inserted into a corresponding inserting slot.

8. The reinforced towel dryer according to claim 4, wherein the lower end of the reinforcing plate extends into the supporting section.

9. The reinforced towel dryer according to claim 4, wherein each support comprises a fixing shell and a cover shell covering the fixing shell, the fixing shell is provided with an accommodating cavity, and the lower end of the reinforcing plate is put in the accommodating cavity, and the fixing shell is provided with an aperture through which the reinforcing plate extends.

10. The reinforced towel dryer according to claim 9, wherein a positioning column is provided in the accommodating cavity, a positioning hole is provided on the reinforcing plate, and the positioning column is inserted into the positioning hole.

11. The reinforced towel dryer according to claim 1, wherein the main machine further comprises an ultraviolet light source installed on the casing, and the hanger further comprises two supporting arms supporting at the two ends of the hanging rod respectively, the two supporting arms are respectively supported on the two supports, and the supporting section is inclined downward from the rear side of the casing to a front side of the casing, one end of each supporting arm is rotatably connected to a front end of a corresponding supporting section, and each supporting arm is connected to the hanging rod at a position close to another end of the supporting arm.

12. The reinforced towel dryer according to claim 11, wherein the front end of each supporting section is provided with a rotating shaft, and each of the two supporting arms is provided with a damping sleeve sleeved on the rotating shaft for friction resistance positioning on the rotating shaft.

13. The reinforced towel dryer according to claim 12, wherein each shaft is provided with a shaft hole, the hanger further comprises a fulcrum bar with two ends, and both of the two ends of the fulcrum bar are respectively put in a corresponding shaft hole of the shaft.

14. The reinforced towel dryer according to claim 11, wherein each of the supporting arms is provided with a fixing sleeve that sleeves on the hanging rod.

15. The reinforced towel dryer according to claim 1, wherein the main machine further comprises a lamp socket installed in the casing and an ultraviolet light source detachably installed in the lamp socket, a window exposing the ultraviolet light source is provided on the bottom of the casing, the hanging rod is arranged under the window, and the hanging rod is detachably installed on the two supports.

16. The reinforced towel dryer according to claim 15, wherein one of the two supports is provided with a supporting groove for accommodating a corresponding end of the hanging rod, and another one of the two support is provided with an inserting hole into which another corresponding end of the hanging rod is inserted; or, the two supports are respectively provided with supporting grooves for accommodating the two ends of the hanging rod.

17. A reinforced towel dryer, comprising:

a main machine, comprising:

a casing, and a bottom of the casing being provided with an air outlet and an air inlet;

a fan, installed in the casing, and an outlet of the fan being corresponding to the air outlet of the casing; and a heater, installed in the casing, and arranged in an air flow path of the fan; and a hanger for hanging fabrics, comprising:

a hanging rod; and two supports, respectively supporting two ends of the hanging rod, each support having:

a supporting section, configured for supporting one of the two ends of the hanging rod; and a vertical section configured for abutting against a wall, a lower end of the vertical section being connected to a rear end of the supporting section, and an upper end of the vertical section being fixedly connected to a rear side of the casing, wherein one of the two supports is provided with a supporting groove configured for accommodating a corresponding end of the hanging rod, and another one of the two supports is provided with an inserting hole into which another corresponding end of the hanging rod is inserted; or alternatively, the two supports are respectively provided with supporting grooves for accommodating the two ends of the hanging rod, and wherein the hanger further comprises a locking mechanism configured for positioning one end of the hanging rod in a corresponding supporting groove, and wherein the locking mechanism is installed on a support provided with the corresponding supporting groove.

18. The reinforced towel dryer according to claim 17, wherein the locking mechanism comprises an inserting block inserted into the supporting groove and a positioning component that elastically abuts against the inserting block, and the one end of the hanging rod is fixedly connected to the inserting block, and the positioning component is installed in the support.

19. The reinforced towel dryer according to claim 18, wherein the inserting block is provided with a clamping slot, and the positioning component comprises a top protrusion extending into the clamping slot, a supporting block supporting the top protrusion, an elastic member that elastically abuts against the supporting block toward the inserting block, and a button used to push the supporting block away from the inserting block, the supporting block and the elastic member are installed in the support, the support is provided with an opening exposing the button, and the top protrusion extends into the supporting groove.

20. The reinforced towel dryer according to claim 19, wherein the elastic member is a spring, the supporting block is further provided with a positioning shaft on which the spring is sleeved, and the positioning shaft and the top protrusion are respectively located on opposite sides of the supporting block.

* * * * *